US008827766B2

(12) United States Patent
Lin

(10) Patent No.: US 8,827,766 B2
(45) Date of Patent: Sep. 9, 2014

(54) BRA FASTENER ASSEMBLY

(76) Inventor: Chi Wing Leslie Lin, San Po Kong (CN)

( * ) Notice: Subject to any disclaimer, the term of this patent is extended or adjusted under 35 U.S.C. 154(b) by 216 days.

(21) Appl. No.: 13/530,286

(22) Filed: Jun. 22, 2012

(65) Prior Publication Data

US 2013/0029561 A1 Jan. 31, 2013

(30) Foreign Application Priority Data

Jun. 25, 2011 (HK) ..... 11106585.5

(51) Int. Cl.
*A41C 3/00* (2006.01)
*A41F 1/00* (2006.01)
*A44B 11/25* (2006.01)

(52) U.S. Cl.
CPC ..... *A41F 1/006* (2013.01); *A44B 11/2596* (2013.01)
USPC ..... 450/86; 2/327; 2/326; 2/336; 24/197; 24/198; 24/200

(58) Field of Classification Search
USPC ..... 450/86, 1; 2/336, 327, 326; 24/198, 24/197, 200
See application file for complete search history.

(56) References Cited

U.S. PATENT DOCUMENTS

| | | | | |
|---|---|---|---|---|
| 5,964,642 | A * | 10/1999 | Fildan | 450/86 |
| 7,278,900 | B1 * | 10/2007 | Ostaseski | 450/86 |
| 7,404,753 | B2 * | 7/2008 | Cheng | 450/86 |
| 7,410,407 | B2 * | 8/2008 | Krammel | 450/58 |
| 7,601,048 | B2 * | 10/2009 | Groner | 450/86 |
| 7,648,408 | B2 * | 1/2010 | Lung | 450/58 |
| 7,785,171 | B1 * | 8/2010 | Baker | 450/86 |
| 7,806,748 | B2 * | 10/2010 | Richardson | 450/61 |
| 8,241,090 | B2 * | 8/2012 | Michael | 450/86 |

* cited by examiner

*Primary Examiner* — Gloria Hale
(74) *Attorney, Agent, or Firm* — Howard C. Muskin; Gloria Tsui-Yip

(57) ABSTRACT

A bra fastener assembly that includes at least two fasteners each attached to the shoulder straps at corresponding distances through a positioning element; between the two fasteners there is a detachable connective element; the positioning element includes the shoulder strap opening in the fastener, the shoulder strap opening includes the positioning element to fix in position the fastener on the shoulder strap, the positioning element includes the first pin within the shoulder strap opening. Through the element the two fasteners can be fixed in position on the bra shoulder strap, at the same time the two fasteners can detach or connect, when connected the fasteners secure the shoulder straps so they stay in the set position, keeping the distance between the shoulder straps fixed, thus preventing the shoulder straps from slipping and the fastener is interchangeable. Different positioning elements for the bra fastener assembly are provided.

20 Claims, 20 Drawing Sheets

BRA FASTENER ASSEMBLY

FIELD OF THE INVENTION

This invention pertains to a kind of accessory for a bra. To be exact, it is about a bra fastener assembly.

BACKGROUND OF THE INVENTION

A bra is a feminine product to protect and enhance the breasts; it is normally made up of band 1', shoulder straps 2', fasteners 3', and cups 4'. As shown in FIG. 1, cups 4' are attached to the top of band 1', its purpose is to support or protect the wearer's breasts; band 1' goes around below the wearer's breast encircling the body to stay in position; the two ends of shoulder straps 2' are connected to cups 4' and band 1', spanning over the wearer's shoulder, distributing the force on cups 4' to the shoulders to provide support; a fastener 3' is normally located on the band 1', allowing the band 1' to be unfastened into open ended circle, for ease of putting on. Fastener 3' can be made to be adjustable, to allow the band 1' circumference to match the torso circumference below the breasts. Where the shoulder straps 2' and the cups 4' meet, fasteners 3' may be located, to allow taking apart for cleaning; the same fasteners 3' may also be an adjustable fastener for length adjustment. Besides that, the fasteners are normally attached and fixed to the shoulder straps or band, not able to be taken apart.

Furthermore, bras are commonly found in front opening or back opening types. In that the front opening type means that fastener 3' is located on frontal part of band 1', between the two cups 4'; whereas back opening means that fastener 3' is located on the back part of band 1' and positioned on the wearer's back.

In the case that the wearer chooses tank tops, sleeveless tops, or wide opening tops which tend to expose more of the shoulder areas, the bra straps 2' in these circumstances easily slips off and are exposed, affecting the wearer's image. Besides that, for those who have slanted shoulders, bra straps 2' also tend to slip off to the sides, making it uncomfortable for the wearer.

SUMMARY OF THE INVENTION

This invention must resolve the technical challenge, target the current issue of the bra strap slipping off, to present a bra fastener assembly, that is able to hold bra straps in their corresponding positions, preventing them from slipping outwards; this invention must also tackle another technical challenge, resolve the inability of the fastener to be detached from the shoulder straps, to present a bra fastener assembly, so that the fasteners of this bra fastener assembly can be detached from the bra shoulder straps.

This invention must resolve the technical challenge with this technical approach: design a bra fastener assembly, it includes positioning structures that are attached to both shoulder straps at corresponding positions with at least two fasteners, between the two said fasteners have detachable connective elements; the said positioning structures includes shoulder strap opening on the said fastener, the said shoulder strap opening comprises the positioning element located on the bra strap, the said positioning element includes the first pin in the said shoulder strap opening.

In the said bra fastener assembly of this invention, the said positioning element also includes the said first pin in the shoulder strap opening as well as the corresponding second pin within the said shoulder strap opening, the movable pin sleeve that slides over the said first pin, the said first and second pins both have one end attached to the inner wall of the said shoulder strap opening.

In the said bra fastener assembly of this invention, the said first pin has one end that can swivel and is connected to the inner wall of the said shoulder strap opening.

In the said bra fastener assembly of this invention, the inner surface of said movable pin sleeve and the outer surface of the said first pin have matching pin locating elements.

In the said bra fastener assembly of this invention, the inner surface of said movable pin sleeve and the outer surface of the said second pin have matching pin locating elements.

In the said bra fastener assembly of this invention, the said movable pin sleeve can glide on the surface of the said first pin, allowing the said movable pin sleeve and the said second pin to disengage or engage.

In the said bra fastener assembly of this invention, there is at least one extending element from the said first pin surface that can move towards the inner wall of the said shoulder strap opening, the said extending element and the inside surface of the said movable pin sleeve matches up.

In the said bra fastener assembly of this invention, the maximum outer length of the said movable pin sleeve is more than the distance between the opposing ends of the said first pin and the said second pin.

In the said bra fastener assembly of this invention, the pin locating element includes a convex locating element on the inside of the movable sleeve and a concave locating element on the surfaces of the said first and second pins.

In the said bra fastener assembly of this invention, the said pin locating element includes the convex locating element on the surface of the said movable pin sleeve.

In the said bra fastener assembly of this invention, there are at least two concave locating elements on the surface of the said first pin, one of which is rectangular.

In the said bra fastener assembly of this invention, there is a thorough aperture that passes from the inner wall of the shoulder strap opening to the outer sidewall of the said fastener, the said shoulder strap positioning element is in the said aperture.

In the said bra fastener assembly of this invention, the end of said shoulder strap positioning element and said inner wall of the shoulder strap opening have a corresponding alignment hole and a corresponding alignment convex post, the said shoulder strap opening has an extendable fixed pin on the inner wall of said shoulder strap opening pointing towards the shoulder strap positioning element, said alignment hole or alignment convex post are located on said fixed pin and said corresponding end of said shoulder strap positioning element.

In the said bra fastener assembly of this invention, the said shoulder strap positioning element includes the said aperture and corresponding strap rod and slide rod, the said shoulder strap opening's inner wall has a glide track that corresponds to said slide rod, within the inner wall of the said shoulder strap opening and from the said opening through to the outer sidewall of the said fastener is the aperture with the corresponding strap rod and slide rod, the said glide track and corresponding aperture has a pass through structure, the inner wall of the said shoulder strap opening has a fixed pin that corresponds to the said strap rod of the said shoulder strap positioning element, the ends of the said fixed pin and strap rod of the shoulder strap positioning element have a corresponding alignment hole and a corresponding alignment convex post.

In the said bra fastener assembly of this invention, the said first pin has one end that can swivel and connect to the inner wall of the said shoulder strap opening.

In the said bra fastener assembly of this invention, the said first pin is designated as the long pin, at the opposing position of the said long pin is the short pin, the said pin gap is the distance between the said long and short pins. The length ratio of said long pin and short pin is set as 2:1~3:1, the said pin gap is set as 1~1.2 mm.

In the said bra fastener assembly of this invention, the said detachable connective element includes the corresponding hook and eye set between the two said fasteners.

In the said bra fastener assembly of this invention, the said detachable connective element includes the corresponding glide rail and glide track between the two said fasteners.

In the said bra fastener assembly of this invention, the said detachable connective element includes the corresponding fixed gap between the two said fasteners, between the two said fasteners and the said fixed gap are the corresponding alignment concave notch and alignment convex platform.

In the said bra fastener assembly of this invention, the said shoulder strap positioning element attachment point to the operable fastener is located on the inner wall of the said shoulder strap opening and the gap end is detachably connected to the inner wall of the said shoulder strap opening; the said shoulder strap positioning element attachment point is a rotational connection to the inner wall of the said shoulder strap opening, the rotation plane of the said shoulder strap positioning element is perpendicular to the said shoulder strap opening; the said shoulder strap positioning element has a detachable connection to the inner wall of the said shoulder strap opening; the said shoulder strap opening's inner wall has a guide rail, the said shoulder strap positioning element's slide mechanism is located on the said guide rail; between the gap end of said shoulder strap positioning element and the said shoulder strap opening's inner wall is the corresponding tongue and groove; the fitting surface of the said tongue and groove has a draft angle, between the said tongue and groove is an elastic rubber stop; the said detachable connective element includes between the two fasteners the corresponding eye and hook; the said detachable connective element includes the corresponding glide rail and glide track between the two said fasteners; the said glide track has a stop position on one end; the said detachable connective element includes the corresponding fixed gap between the two said fasteners.

In another embodiment, the advantages are below: installing two fasteners individually on the two bra straps, at the same time the two fasteners can be detached or connected, therefore it is possible to hold the two bra straps firmly in position when the two fasteners are connected, such that the distance between the two bra straps is fixed, therefore preventing the bra straps from slipping; the positioning element includes the shoulder strap opening on the fastener, and movable pin within the shoulder strap opening, the shoulder strap positioning element divides the shoulder strap opening into two sections. To put on or off, first open the shoulder strap positioning element, so that the pin gap forms inside shoulder strap opening, this way the ribbon or shoulder strap can be slotted into the shoulder strap opening, and fixed in place in the shoulder strap opening by the shoulder strap positioning element, thereby the fastener assembly is attached to the shoulder strap or ribbon, and if the need arises the fastener assembly can easily be detached, allowing the wearer to take off the fastener if desired, allowing the bra components to come apart for ease of washing, or depending on need using different fastener assemblies.

DESCRIPTION OF THE FIGURES

Combined figures and embodiments to further explain the invention, figures as follows.

DETAILED IMPLEMENTATION

Figure 1:
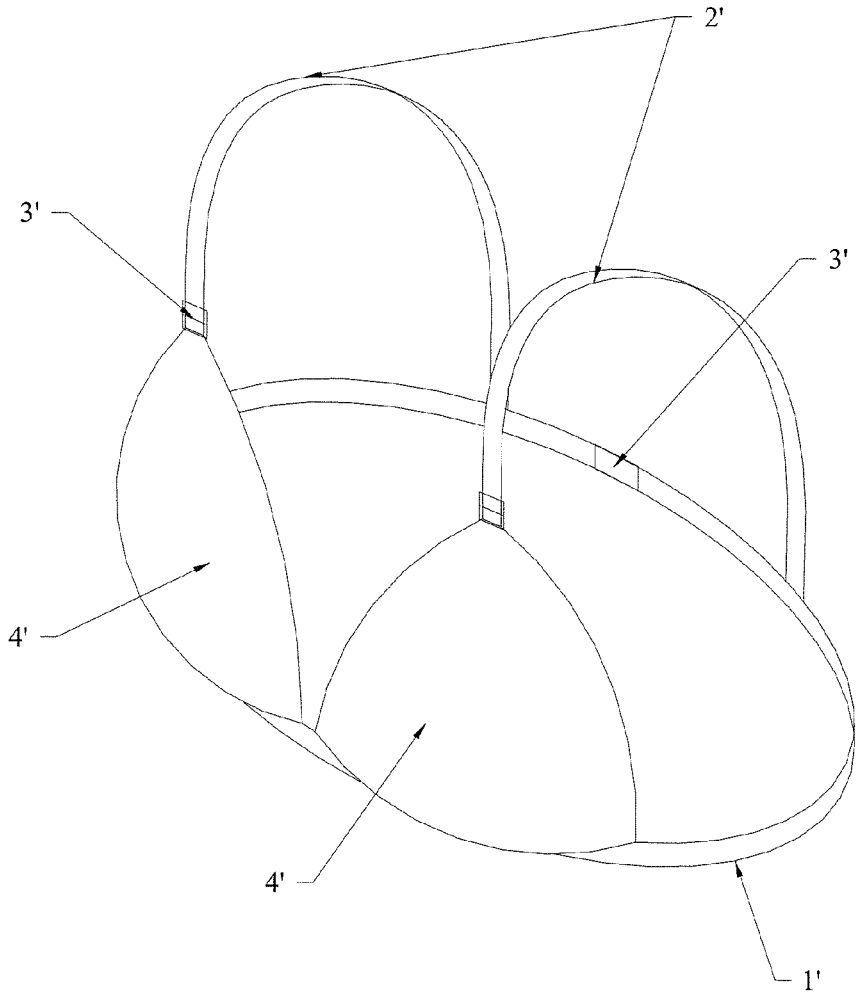
FIG. 1 shows a prior art bra structure.
Figure 1A:
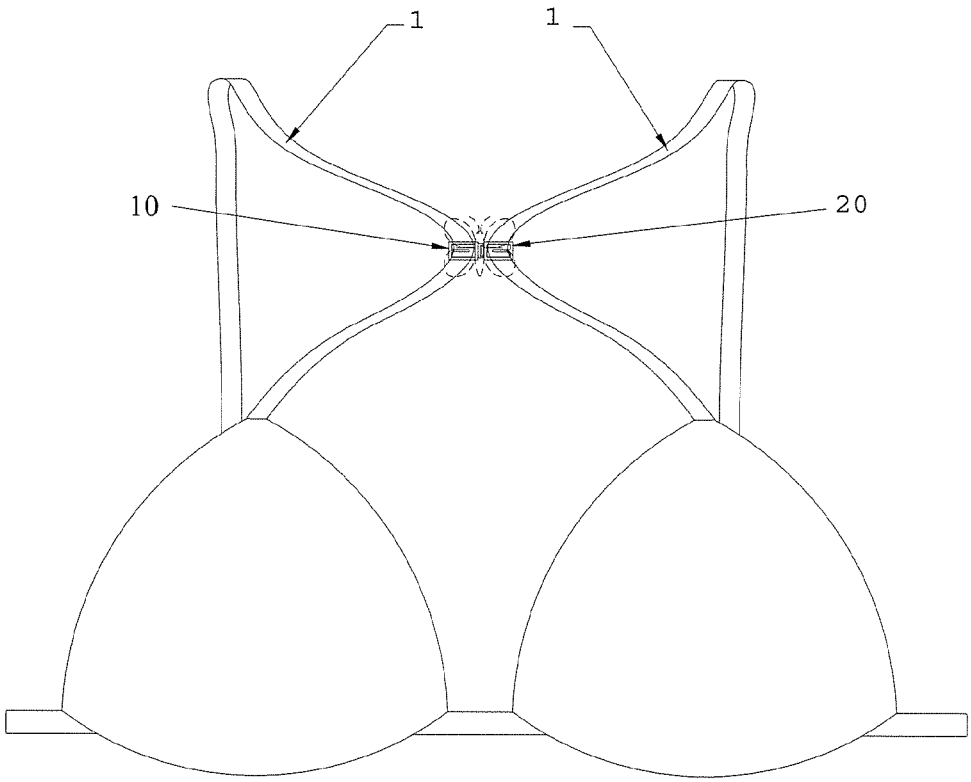
FIG. 1*a* shows the installation diagram of the said bra fastener assembly of this invention.
Figure 1B:
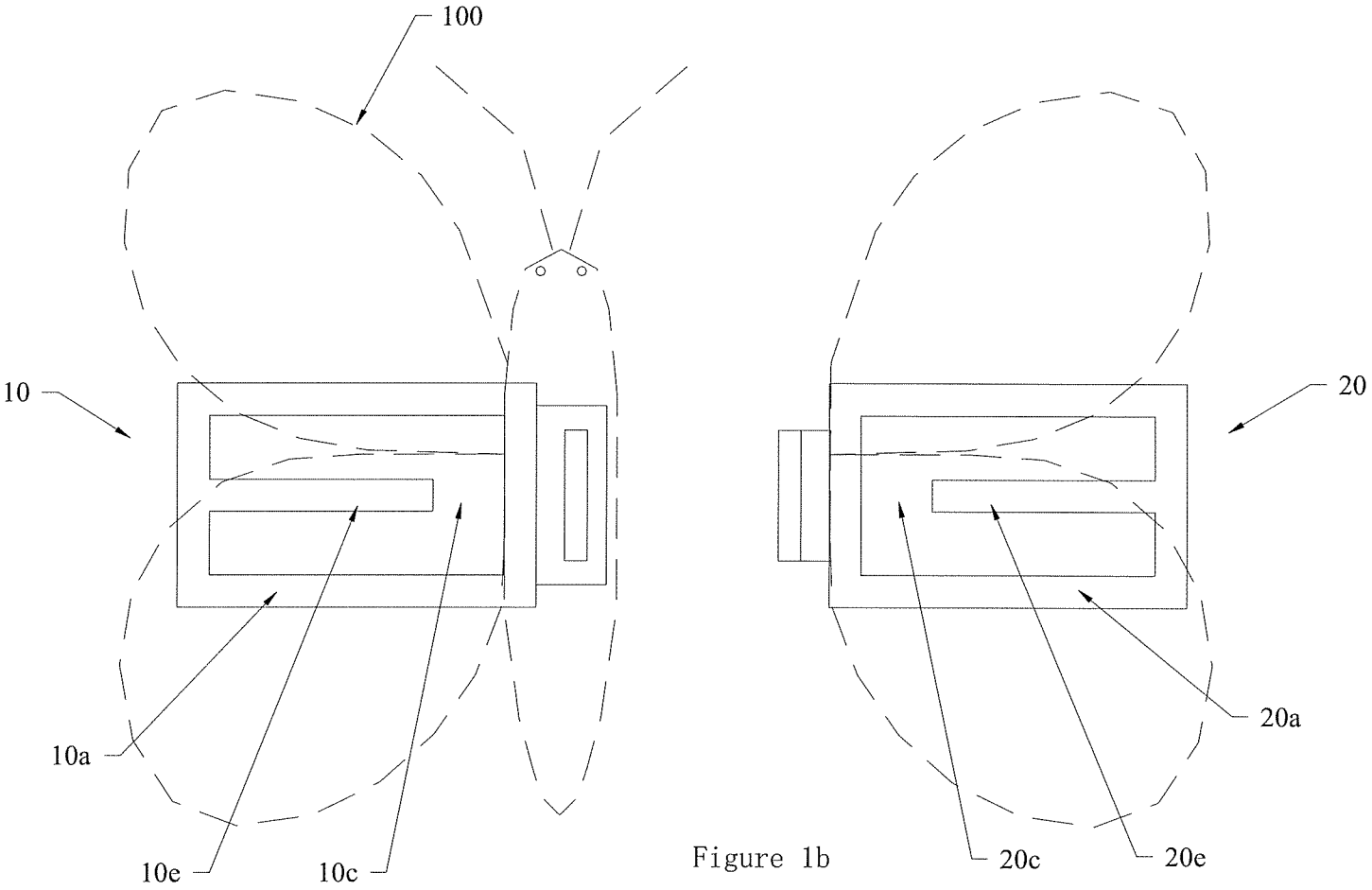
FIG. 1*b* shows the diagram of the first embodiment of the said bra fastener assembly of this invention.

As shown in FIGS. 1*a*, 1*b*, in the first embodiment of the said bra fastener assembly of this invention, the two fasteners include the first fastener 10 and the second fastener 20, both the first fastener 10 and the second fastener 20 are attached to the shoulder straps 1 by positioning elements. The positioning element can be many different shapes and sizes, in this embodiment, the preferred positioning element includes the shoulder strap opening 10*a* (or 20*a*) and the first pin or a pin 10*e* (or 20*e*) that is installed in the shoulder strap opening 10*a* (or 20*a*), the said first pin or pin 10*e* has one end attached to the inside of the shoulder strap opening 10*a* (or 20*a*) and the other end of the pin forms an gap 10*c* (or 20*c*) with the shoulder strap opening 10*a* (or 20*a*).

In another embodiment of the said bra fastener assembly of this invention, of both fasteners 10 and 20, both the fasteners have the positioning elements at one side, to allow the fasteners to stay on the shoulder straps 1 in their corresponding positions; the other side of both fasteners have a detachable connective element allowing both the fasteners to be interconnected, or be disconnected when not needed, it is also detachable from the shoulder straps. The removable fastener can come in different forms. In the said bra fastener assembly of this invention, the positioning element of each bra fastener is identical, the shoulder strap positioning element includes the shoulder strap opening on the fastener, the shoulder strap opening contains the shoulder strap positioning element or movable pin that lies perpendicular to the axis of the shoulder strap opening dividing the shoulder strap opening into two sections, allowing the shoulder strap opening to form a gap. When the shoulder strap positioning element is open, the shoulder strap opening forms a pin gap, so that it is easy to attach the shoulder strap opening to the shoulder strap; when the shoulder strap positioning element is closed, the pin gap is closed, so that the shoulder strap is securely fixed in the shoulder strap opening.

Figure 2A:
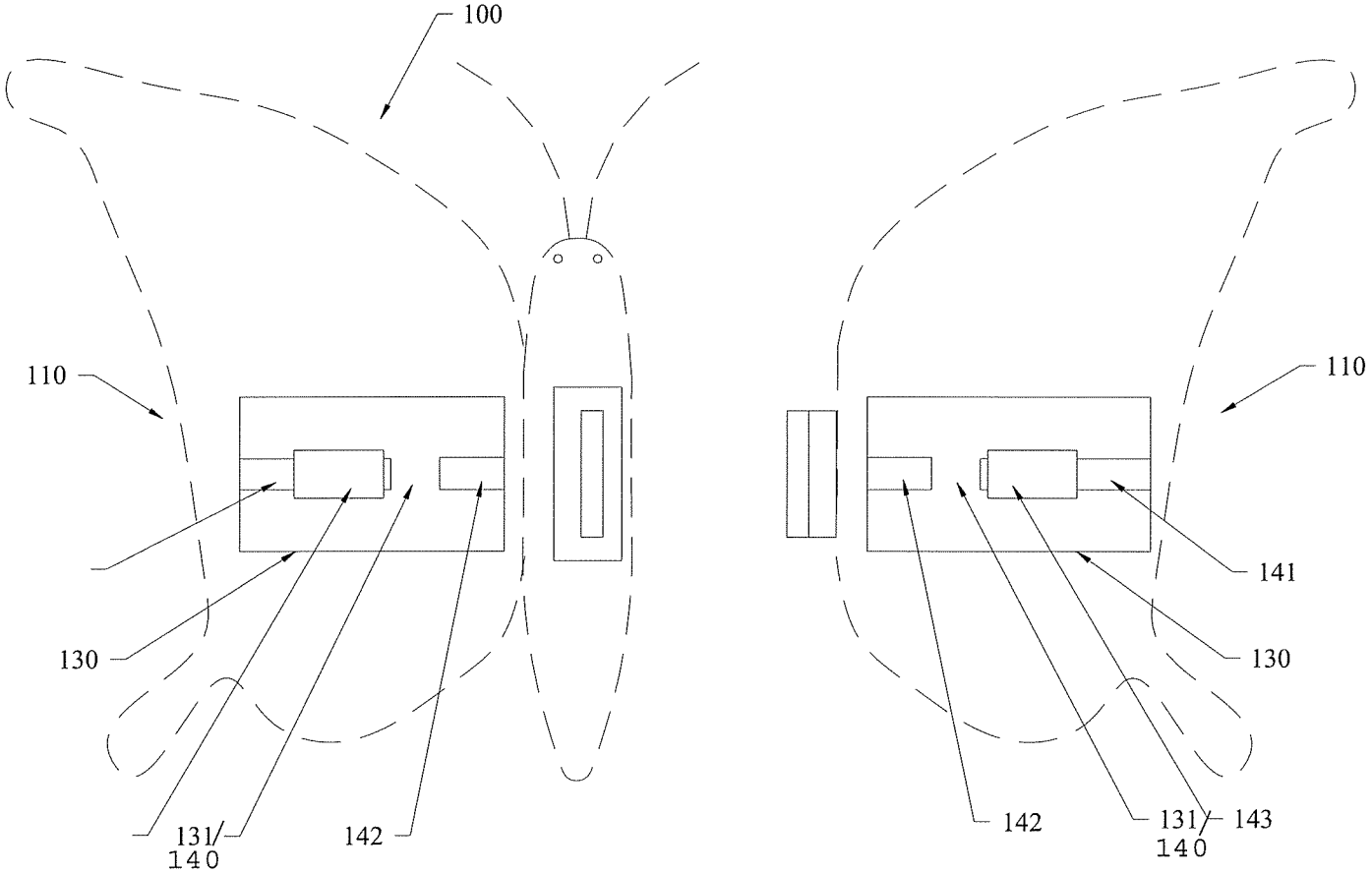
FIG. 2*a* shows the diagram of the second embodiment of the said bra fastener assembly of this invention in the open position.
Figure 2B:
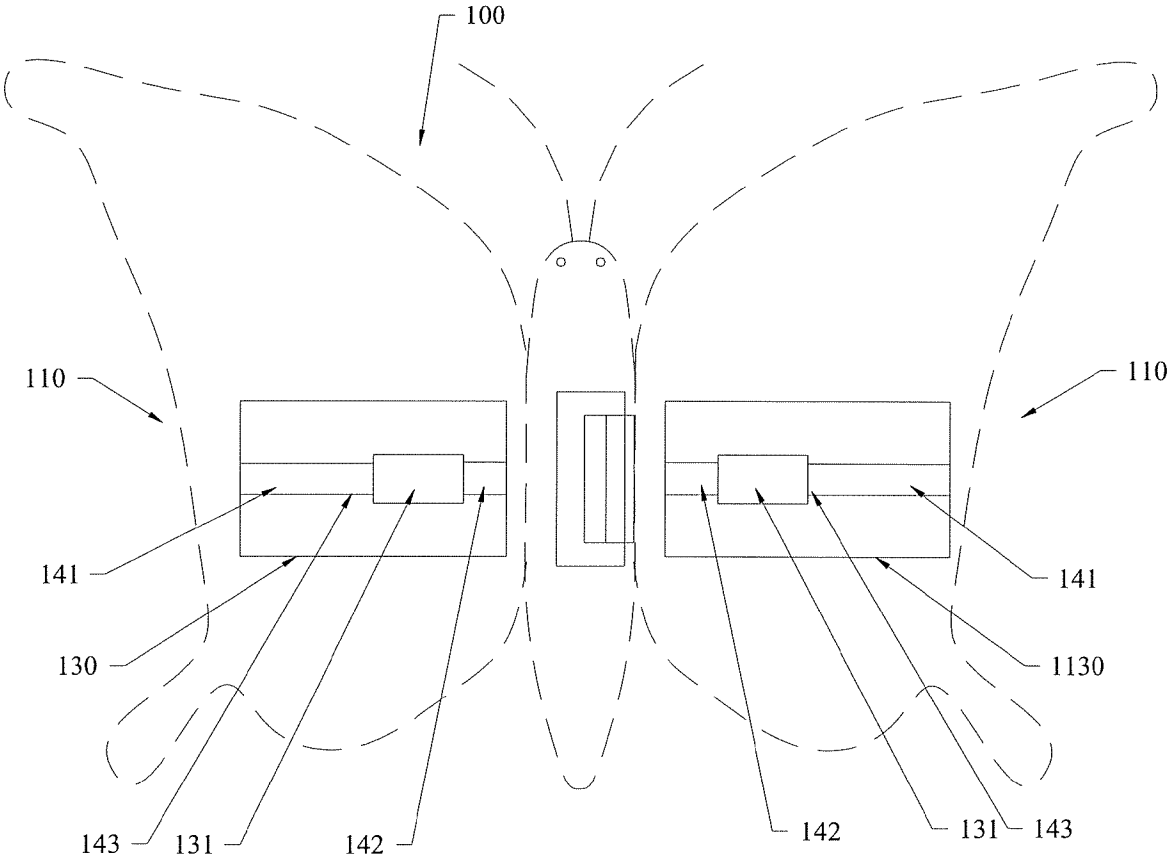
FIG. 2*b* shows the diagram of the second embodiment of the said bra fastener assembly of this invention in the closed position.

In the second embodiment of the said bra fastener assembly of this invention, both fasteners 110 are attached to the shoulder straps through the positioning elements, both fasteners have identical positioning elements. As shown in FIGS. 2*a*, 2*b*, in this embodiment, each fastener 110 has a positioning element including the shoulder strap opening 130, within the shoulder strap opening 130 there is the strap positioning element or movable pin 140, strap positioning element or movable pin 140 lies perpendicular to the axis of the shoulder strap opening dividing the shoulder strap opening into two sections; when the strap positioning element 140 is in action, within the shoulder strap opening 130 forms the pin gap 131. In this embodiment, preferably the positioning element or movable pin 140 including shoulder strap opening and the two fixed pins in the opening including the first and second pins 141, 142 and that on the first or second pins, the movable pin sleeve 143 that slides over first or second pins, the two fixed pins including first and second pins 141, 142 and the pin gap 131 between them. When the movable sleeve 143 slides in position to touch only one fixed pin 141 (or 142), pin gap 131 is open, the shoulder strap can be inserted or detached; when the movable sleeve 143 slides in position to touch both fixed pins 141, 142, the pin gap is closed by movable sleeve 143, so that the shoulder strap is fixed in position within the shoulder strap opening 130. The inside surface of movable sleeve 143 has a position lock convex element, the outer surface of the first pin 141 has a position lock concave element which corresponds to the convex element, its purpose is to fix in position and lock the movable sleeve 143 to first pin 141, to prevent the movable sleeve 143 when in use from displacement; besides, the movable sleeve's maximum outer length is more than the distance between the ends of the first and the second pins, to prevent the movable sleeve from falling out of the gap between the first and the second pins. A step further, at least one extending part that glides on the surface of the first pin towards the shoulder strap opening, the extending part and the inner surface of the movable sleeve matches up, the extending part forms a track, allowing the movable sleeve to glide on the extending part, furthermore, the outer surface of the movable sleeve has a convex part, making it easy for the wearer to put the hand over such part, to put pressure on the movable sleeve, to glide along the surface of the first pin.

Figure 3A:
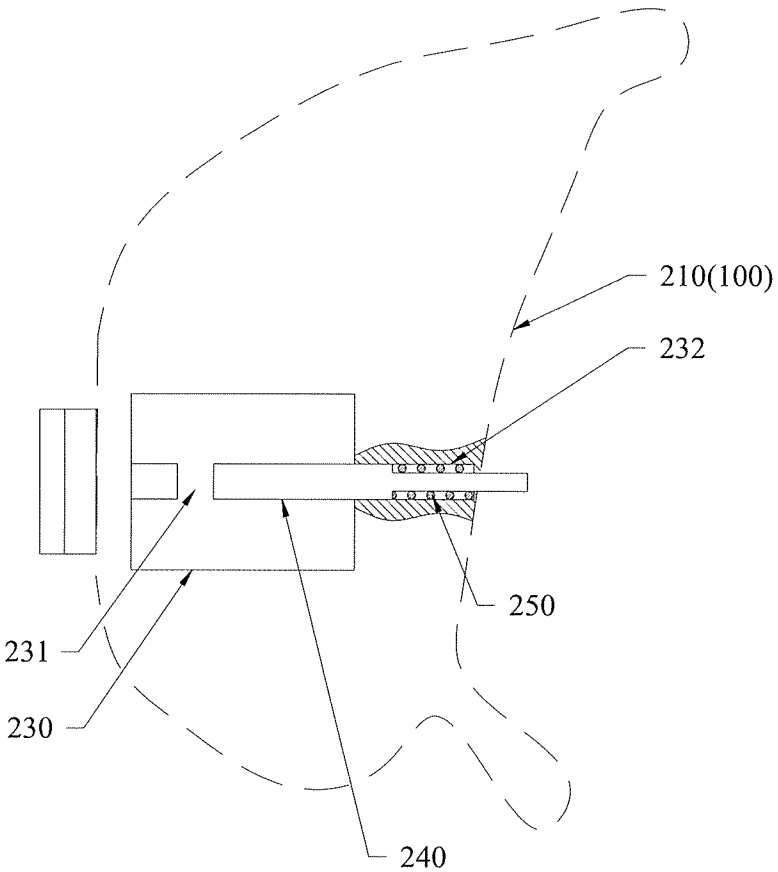
FIG. 3*a* shows the diagram of the third embodiment of the shoulder strap positioning element of the said bra fastener assembly of this invention in the closed position.
Figure 3B:
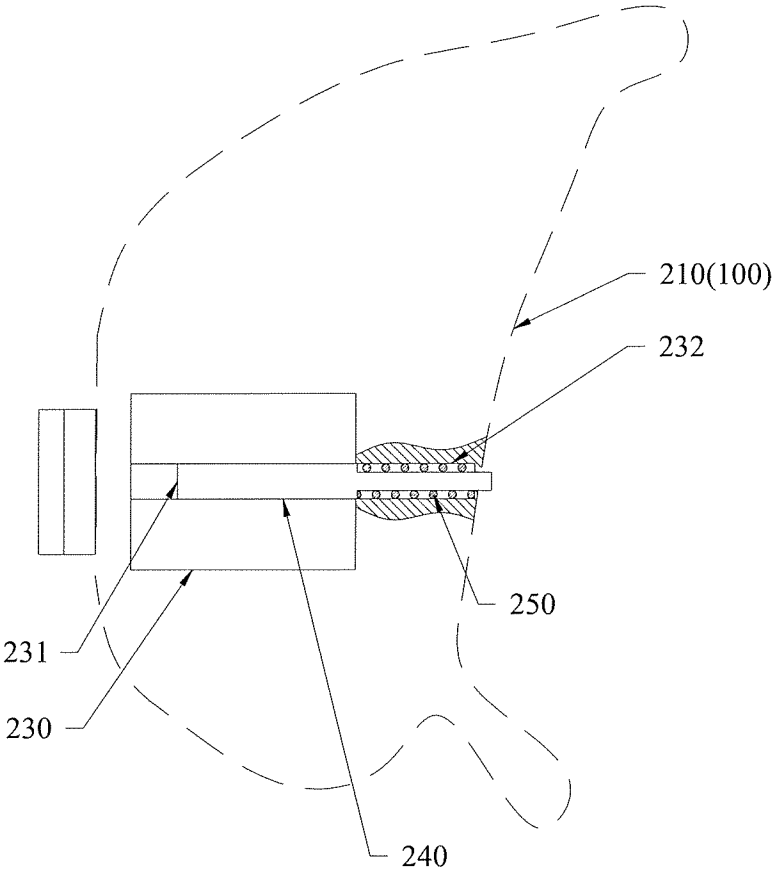
FIG. 3*b* shows the diagram of the third embodiment of the shoulder strap positioning element of the said bra fastener assembly of this invention in the open position.

In the third embodiment of the bra fastener assembly of this invention, both fasteners 210 are attached to the shoulder straps by the positioning elements, both fasteners have identical positioning elements. As shown in FIGS. 3*a*, 3*b*, in this embodiment, the positioning element includes the shoulder strap opening 230 on each fastener 210, the shoulder strap opening 230 has the shoulder strap positioning element or movable pin 240, the shoulder strap positioning element or movable pin 240 is perpendicular to the axis of the shoulder strap opening dividing the shoulder strap opening into two sections; when the shoulder strap positioning element 240 is in action, this creates the pin gap 231 inside the shoulder strap opening 230. In this embodiment, preferably an aperture 232 is located on the inner wall of the shoulder strap opening which moves correspondingly with the shoulder strap positioning element, the aperture 232 passes through the wall of the shoulder strap opening 230 to the outer sidewall of the fastener 210, allowing the shoulder strap positioning element or the movable pin 240 to glide along the aperture 232. When the shoulder strap positioning element or the movable pin 240 glides outward from the aperture 232, the shoulder strap positioning element or the movable pin 240 will create a pin gap 231 with the inner wall of the shoulder strap opening, allowing the shoulder strap to be detached or attached thereto; when the shoulder strap positioning element or the movable pin 240 glides from outer edge of the fastener towards the shoulder strap opening until the end part of the shoulder strap positioning element touches the inner wall of the shoulder strap opening, the pin gap 231 is closed, securing the shoulder strap within the shoulder strap opening. In this embodiment, preferably by installing a compressible elastic assembly 250 between the aperture and the shoulder strap positioning element, like a compression spring for example, so that the shoulder strap positioning element or movable pin 240 have a tendency to glide along the aperture 232 and pin gap 231 and to remain in the closed position, hence during normal usage, the shoulder strap positioning element does not slide out and maintains a firm closure of the pin gap, so that the shoulder strap remains secure inside the shoulder strap opening.

Figure 4A:
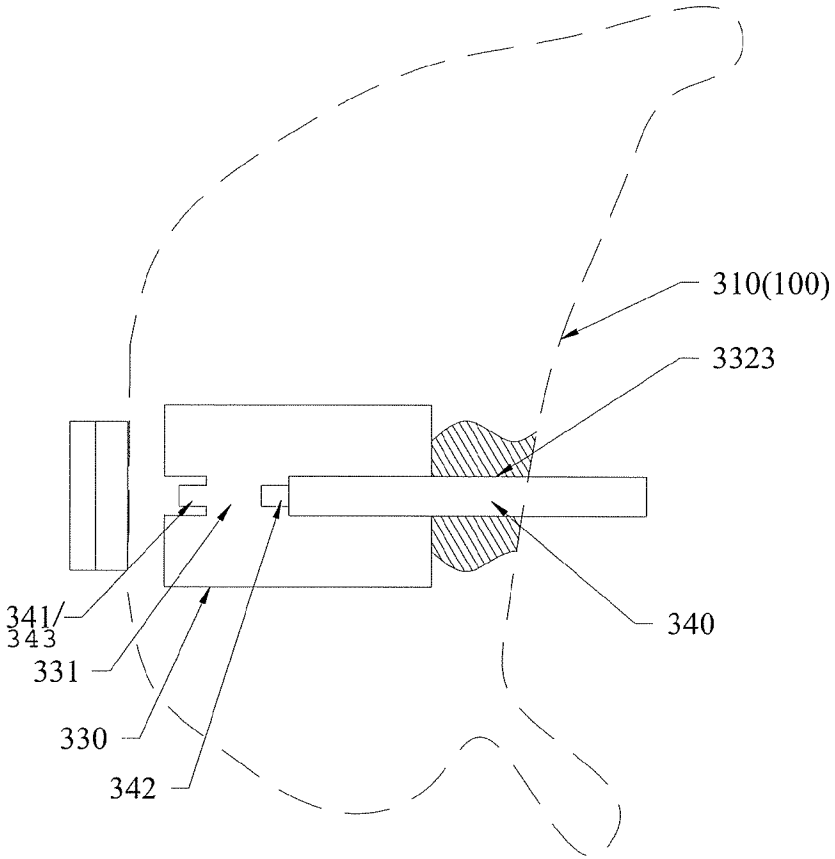
FIG. 4*a* shows the diagram of the fourth embodiment of the shoulder strap positioning element of the said bra fastener assembly of this invention in the closed position.
Figure 4B:
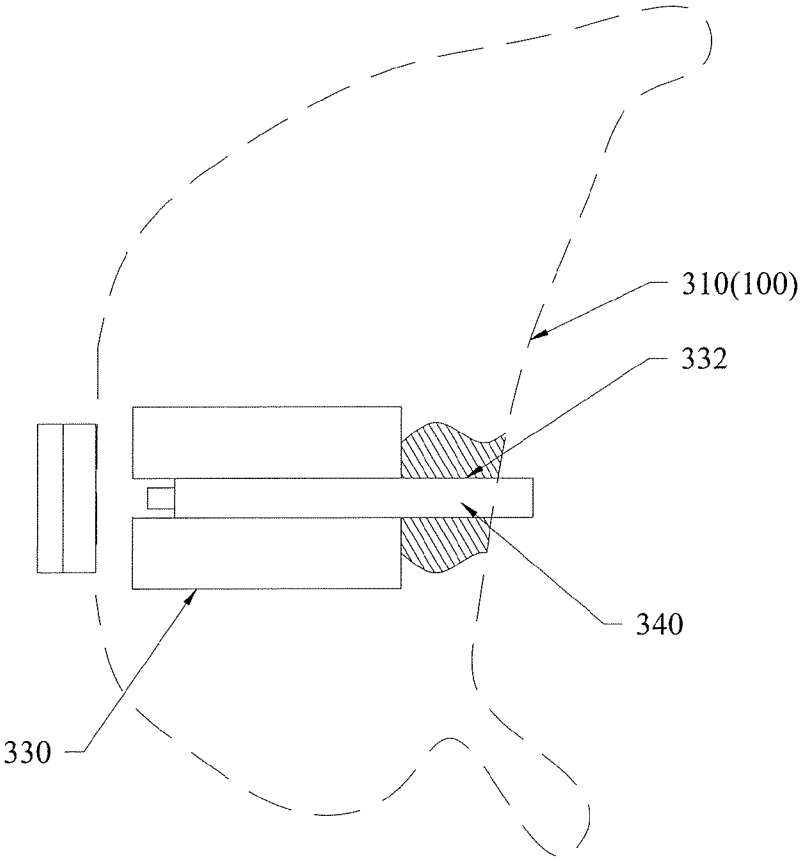
FIG. 4*b* shows the diagram of the fourth embodiment of the shoulder strap positioning element of the said bra fastener assembly of this invention in the open position.

In the fourth embodiment of the bra fastener assembly of this invention, both fasteners 310 are attached to the shoulder straps by the positioning elements, both fasteners have identical positioning elements. As shown in FIGS. 4*a*, 4*b*, in this embodiment, the positioning element includes the shoulder strap opening 330 on each fastener 310, the shoulder strap opening 330 contains the shoulder strap positioning element or movable pin 340, the shoulder strap positioning element or movable pin 340 is perpendicular to the axis of the shoulder strap opening dividing the shoulder strap opening into two sections; when the shoulder strap positioning element 340 is in action, this creates the pin gap 331 inside the shoulder strap opening 330. In this embodiment, as said in the third embodiment above, there is an aperture 332 that is operable and is found inside the wall of the shoulder strap opening and the shoulder strap positioning element, preferably the aperture 332 passes through the inner wall of the shoulder strap opening 330 to the outer sidewall of the fastener 310, allowing the shoulder strap positioning element or the movable pin 340 to glide along the aperture 332. The difference in this embodiment from the third embodiment above is: in this embodiment, preferably there is a corresponding alignment hole 341 and alignment convex post 34 at the end of the shoulder strap positioning element and the inner wall of the shoulder strap opening. This way, when the pin gap 331 is closed by the shoulder strap positioning element or the movable pin 340, the alignment hole 341 and alignment convex post 342 matches up, so that the shoulder strap positioning element or the movable pin 340 remains secure on the wall of the shoulder strap opening and does not slip, therefore the shoulder strap is secured in position within the shoulder strap opening. In this embodiment, the preferred fixed pin 343 that points towards the shoulder strap positioning element on the shoulder strap opening, the said alignment hole 341 and the alignment convex post 342 are installed on the end part of the fixed pin and shoulder strap positioning element, therefore it shortens the gliding distance the shoulder strap positioning element can travel; besides that, when the shoulder strap is secured in the shoulder strap opening, the fixed pin relieves part of the pressure from the shoulder strap, so that the shoulder strap positioning element remains closed and the pin gap firmly closes, taking a step further to ensure the shoulder strap stays securely in the shoulder strap opening.

Figure 5A:
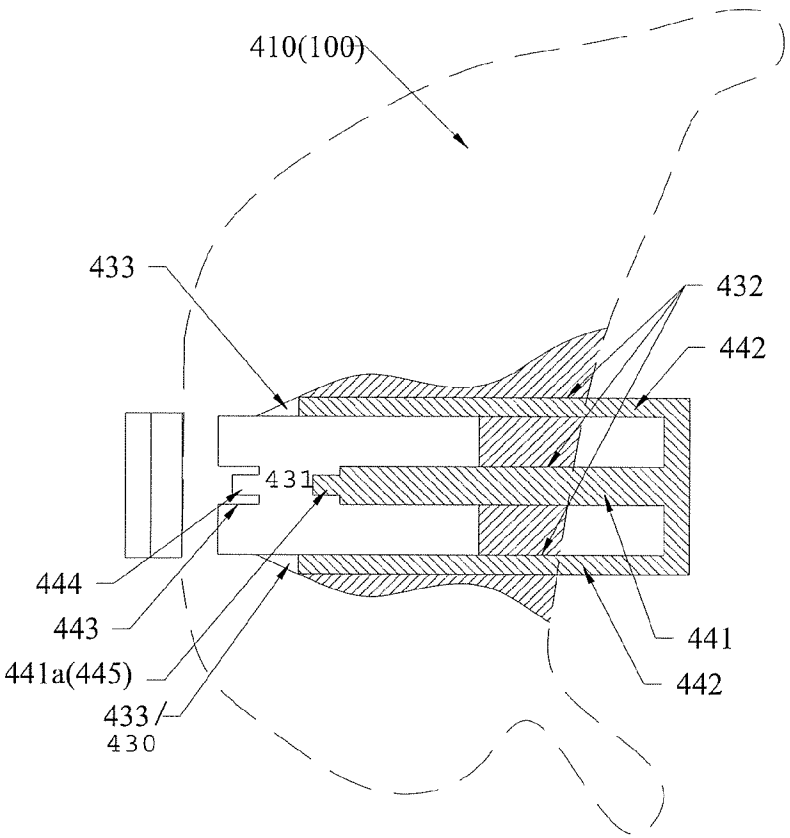
FIG. 5*a* shows the diagram of the fifth embodiment of the shoulder strap positioning element of the said bra fastener assembly of this invention in the closed position.
Figure 5B:
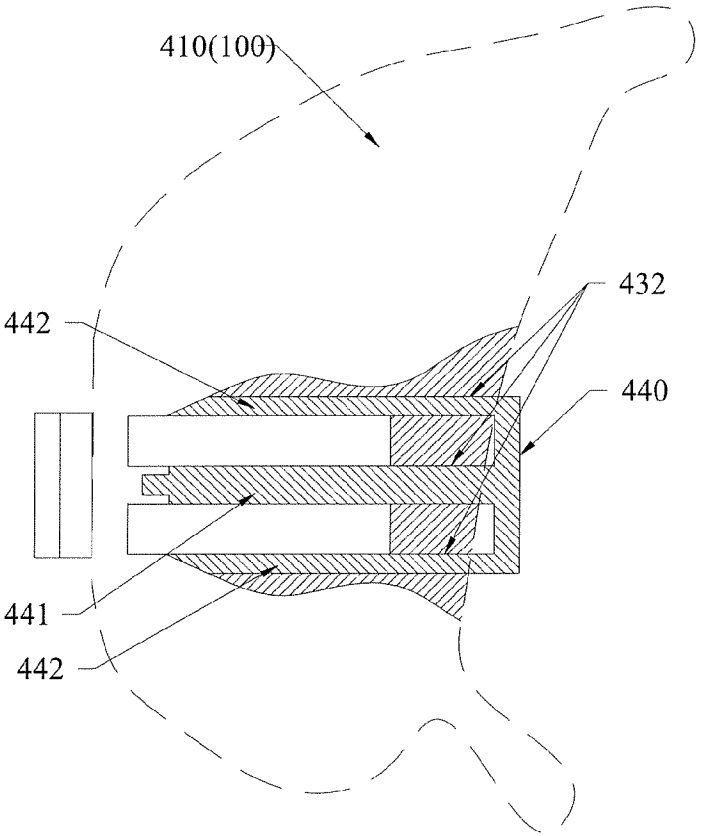
FIG. 5*b* shows the diagram of the fifth embodiment of the shoulder strap positioning element of the said bra fastener assembly of this invention in the open position.

In the fifth embodiment of the bra fastener assembly of this invention, both the fasteners 410 are attached to the shoulder straps by the positioning elements, both fasteners have identical positioning elements. As shown in FIGS. 5*a*, 5*b*, in this embodiment, the positioning element includes the shoulder strap opening 430 on each fastener 410, the shoulder strap opening 430 contains the shoulder strap positioning element or movable pin 440, the shoulder strap positioning element or movable pin 440 lies perpendicular to the axis of the shoulder strap opening dividing the shoulder strap opening into two sections; when the shoulder strap positioning element 440 is in action, this creates the pin gap 431 inside the shoulder strap opening 430. In this embodiment, as in the said third embodiment above, preferably there is an aperture 432 that is operable and is inside the inner wall of the shoulder strap opening and the shoulder strap positioning element, the aperture 432 passes through the wall of the shoulder strap opening 430 to the outer sidewall of the fastener 410, allowing the shoulder strap positioning element or the movable pin 440 to glide along the aperture. The difference in this embodiment from the third embodiment above is: preferably the shoulder strap positioning element includes a strap rod 441 and two slide rods 442, the opposing wall of the shoulder strap opening has three apertures 432 that matches up with strap rod 441 and slide rods 442, there is also a glide track 433 that matches up with the slide rod 442 on the wall of the shoulder strap opening. When the shoulder strap positioning element or movable pin 440 closes the pin gap 431, the end of strap rod 441 of the shoulder strap positioning element glides along the aperture 432 and touches the inner wall of the shoulder strap opening, and slide rods 442 of the shoulder strap positioning element insert into the corresponding apertures along the glide track 433; when the shoulder strap positioning element or movable pin 440 opens up the pin gap 431, the end part of the strap rod 441 within the shoulder strap positioning element comes apart from the inner wall of the shoulder strap opening, and the pin gap 431 opens up between the inner wall of the shoulder strap opening and the strap rod, at the same time the slide rods of the shoulder strap positioning element glide along the glide tracks. When the shoulder strap positioning element opens or closes the pin gap, the slide rods only move along the glide tracks, so that the movement of the shoulder strap positioning element is sure and accurate, and the pressure from the shoulder strap will not cause the shoulder strap positioning element to deviate from the glide tracks. Preferably there is a fixed pin 443 on the inner wall of the shoulder strap opening, this fixed pin matches up with the end of the strap rod of the shoulder strap positioning element, there can be an alignment hole 444 and an alignment convex post 445 at the end of the fixed pin and the end of the strap rod on the shoulder strap positioning element, so that the strap rod of the shoulder strap positioning element aligns securely to the end of the fixed pin, so that the pin gap closes securely.

Figure 6A:
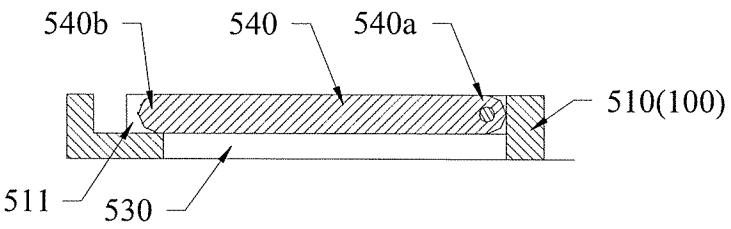
FIG. 6*a* shows the diagram of the sixth embodiment of the shoulder strap positioning element of the said bra fastener assembly of this invention in the closed position.
Figure 6B:
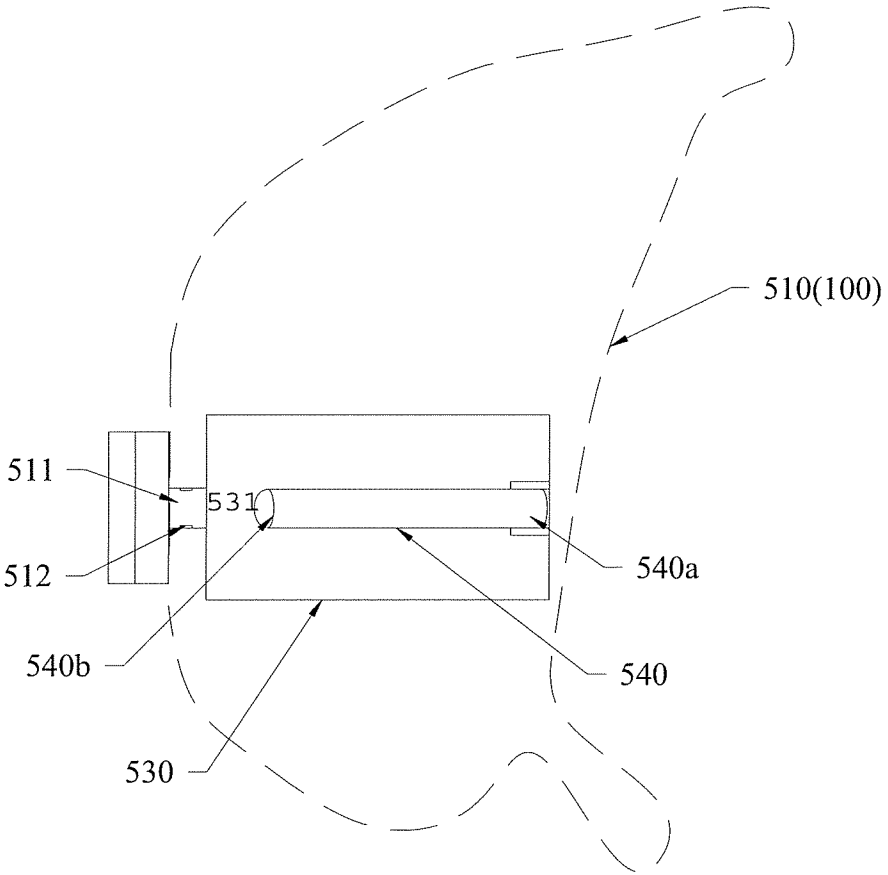
FIG. 6*b* shows the diagram of the sixth embodiment of the shoulder strap positioning element of the said bra fastener assembly of this invention in the open position.

In the sixth embodiment of the bra fastener assembly of this invention, both fasteners 510 are attached to the shoulder straps by the positioning elements, both fasteners 510 have identical positioning elements. As shown in FIGS. 6*a*, 6*b*, in this embodiment, the positioning element includes the shoulder strap opening 530 on each fastener 510, the shoulder strap opening 530 contains the shoulder strap positioning element or movable pin 540, the shoulder strap positioning element or movable pin 540 lies perpendicular to the axis of the shoulder strap opening dividing the shoulder strap opening into two sections; when the shoulder strap positioning element 540 is in action, this creates the pin gap 531 inside the shoulder strap opening 530. In this embodiment, preferably on the fastener near the inner wall of the shoulder strap opening there is an alignment track 511, one end of the shoulder strap positioning element is a swivel end 540*a*, the swivel end is installed on the inner wall of the shoulder strap opening; and the other end of the shoulder strap positioning element is the free end 540*b*, that free end and the alignment track matches. When the free end of the shoulder strap positioning element rotates and unfastens from the fastener, the shoulder strap positioning element detaches from the shoulder strap opening and forms the pin gap, so that the shoulder strap can detach or insert; when the free end of the shoulder strap positioning element clicks into the alignment track of the fastener, the pin gap closes, ensuring the shoulder strap stays securely in shoulder strap opening. The shoulder strap positioning element and the alignment track match accurately, preferably by installing click tab 512 on the wall of the alignment track that matches with the end of the shoulder strap positioning element. When the shoulder strap positioning element click locks into the alignment track, click tab secures the free end of the shoulder strap positioning element inside the alignment track.

Figure 7A:
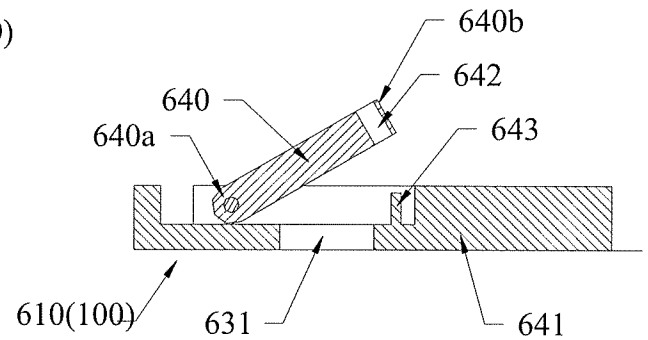
FIG. 7*a* shows the diagram of the seventh embodiment of the shoulder strap positioning element of the said bra fastener assembly of this invention in the closed position.
Figure 7B:
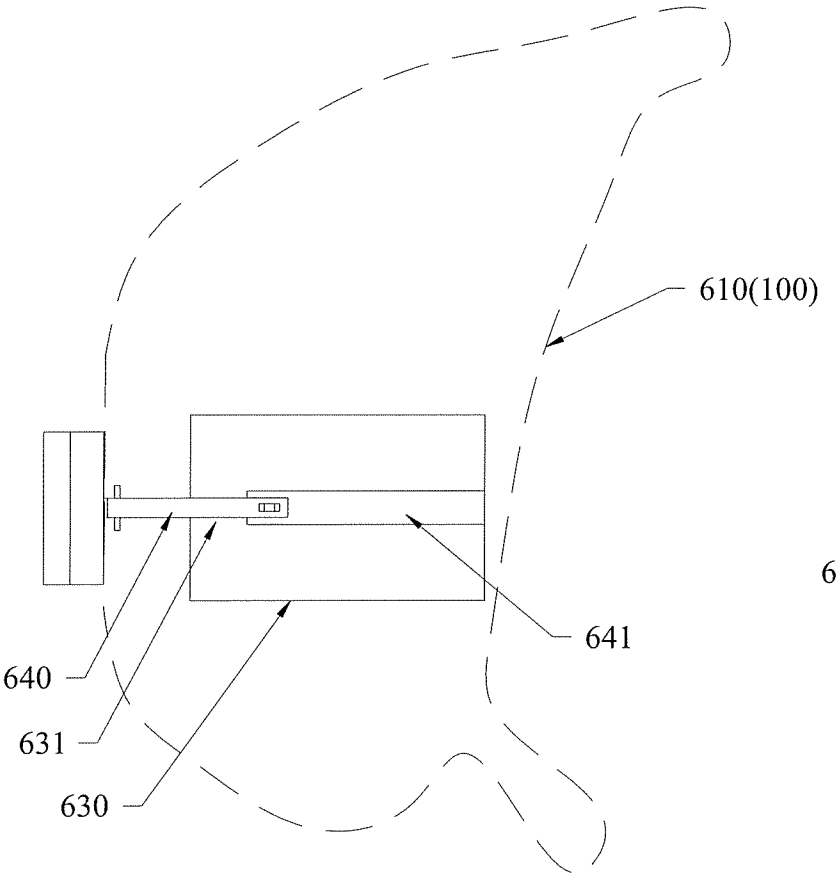
FIG. 7*b* shows the diagram of the seventh embodiment of the shoulder strap positioning element of the said bra fastener assembly of this invention in the open position.

In the seventh embodiment of the bra fastener assembly of this invention, both fasteners 610 are attached to the shoulder straps by the positioning elements, both fasteners 610 have identical positioning elements. As shown in FIGS. 7*a*, 7*b*, in this embodiment, the positioning element includes the shoulder strap opening 630 on each fastener 610, the shoulder strap opening 630 contains the shoulder strap positioning element or movable pin 640, the shoulder strap positioning element or movable pin 640 lies perpendicular to the axis of the shoulder strap opening dividing the shoulder strap opening into two sections; when the shoulder strap positioning element 640 is in action, this creates the pin gap 631 inside the shoulder strap opening 630. In this embodiment, preferably by installing a first pin or fixed pin 641 on the wall of the shoulder strap opening that points towards the shoulder strap positioning element, one end of the shoulder strap positioning element is the swivel end 640*a*, the swivel end is installed on the wall of the shoulder strap opening; and the other end of the shoulder strap positioning element is the free end 640*b*, this free end 640*b* matches up with the first pin or fixed pin 641; between the free end 640*b* of the shoulder strap positioning element and the first pin or fixed pin 641 there is a matching click hole 642 and click post 643. When the free end 640*b* of the shoulder strap positioning element rotates at the swivel end, click hole 642 detaches from click post 643, the pin gap 631 forms as the shoulder strap positioning element or the movable pin 640 detaches from the shoulder strap opening 630, so that the shoulder strap can detach or insert; when the free end of the shoulder strap positioning element rotates towards the first pin or fixed pin 641, the click post 643 locks into click hole 642, the shoulder strap positioning element or movable pin 640 will match up with fixed pin 641, the pin gap 631 closes, securing the shoulder strap inside the shoulder strap opening.

In the embodiments given, for enhancing the look, decorative accent 100 can be added to the outer surface of the bra fastener assembly, such as decorative motifs of small animals. Specifically, the decorative accent 100 can be installed directly onto the fastener's or the first fastener's 10 surface, or install the decorative accent 100 onto the fastener's or the second fastener's 20 surface; also can separate the decorative element 100 into two parts, separately installed on the surface of the fastener or the first fastener 10 and on the surface of the fastener or the second fastener 20, so that when the two fasteners are connected, two parts of the decorative accent 100 become a whole image. Another way is to fashion the actual fastener as the decorative accent, combining the decorative accent and the fastener as one, the shoulder strap opening and the shoulder strap positioning element as part of decorative accent, making the whole structure simpler.

Figure 8A:
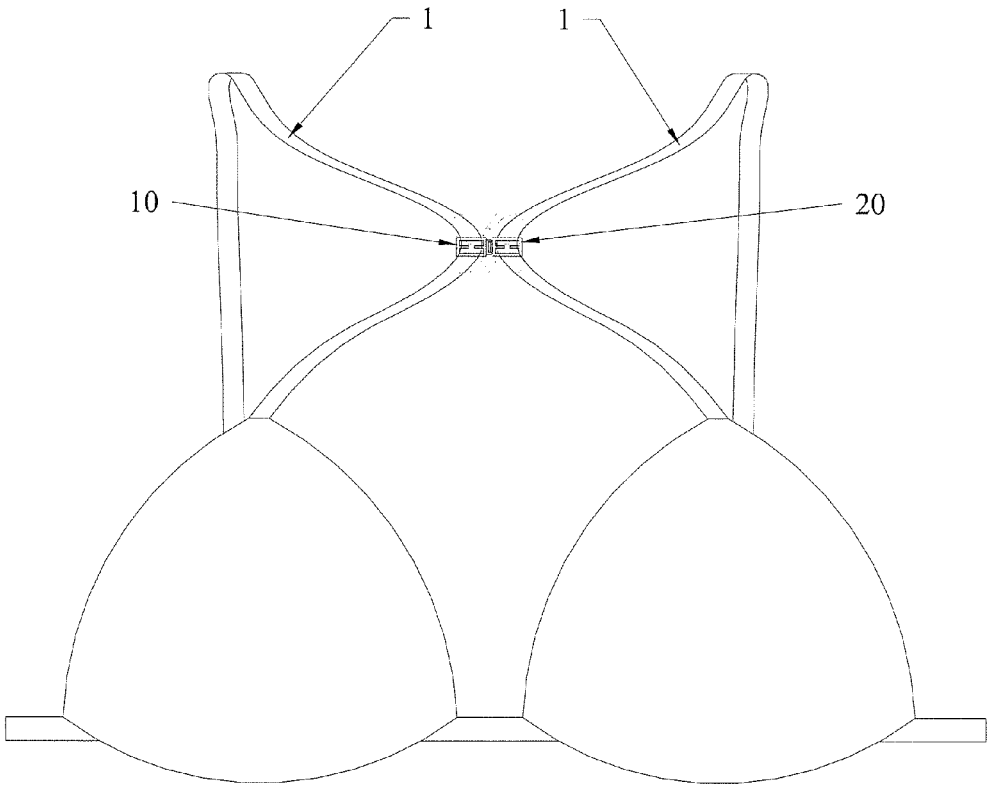
FIG. 8*a* shows the diagram of eighth embodiment of the installation structure of the said bra fastener assembly of this invention.
Figure 9:
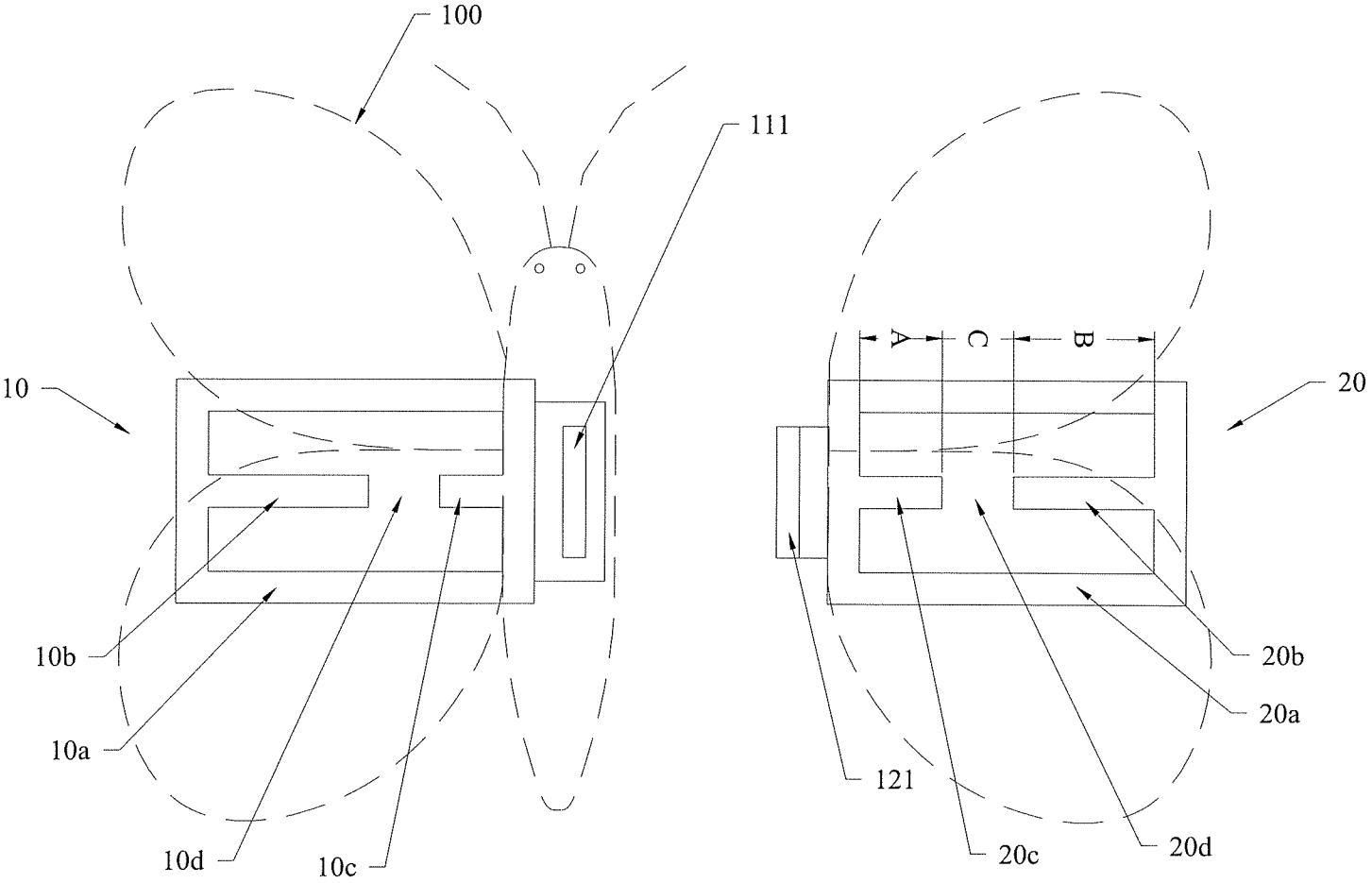
FIG. 9 shows the eighth embodiment of the structure of the said bra fastener assembly of this invention.
Figure 9A:
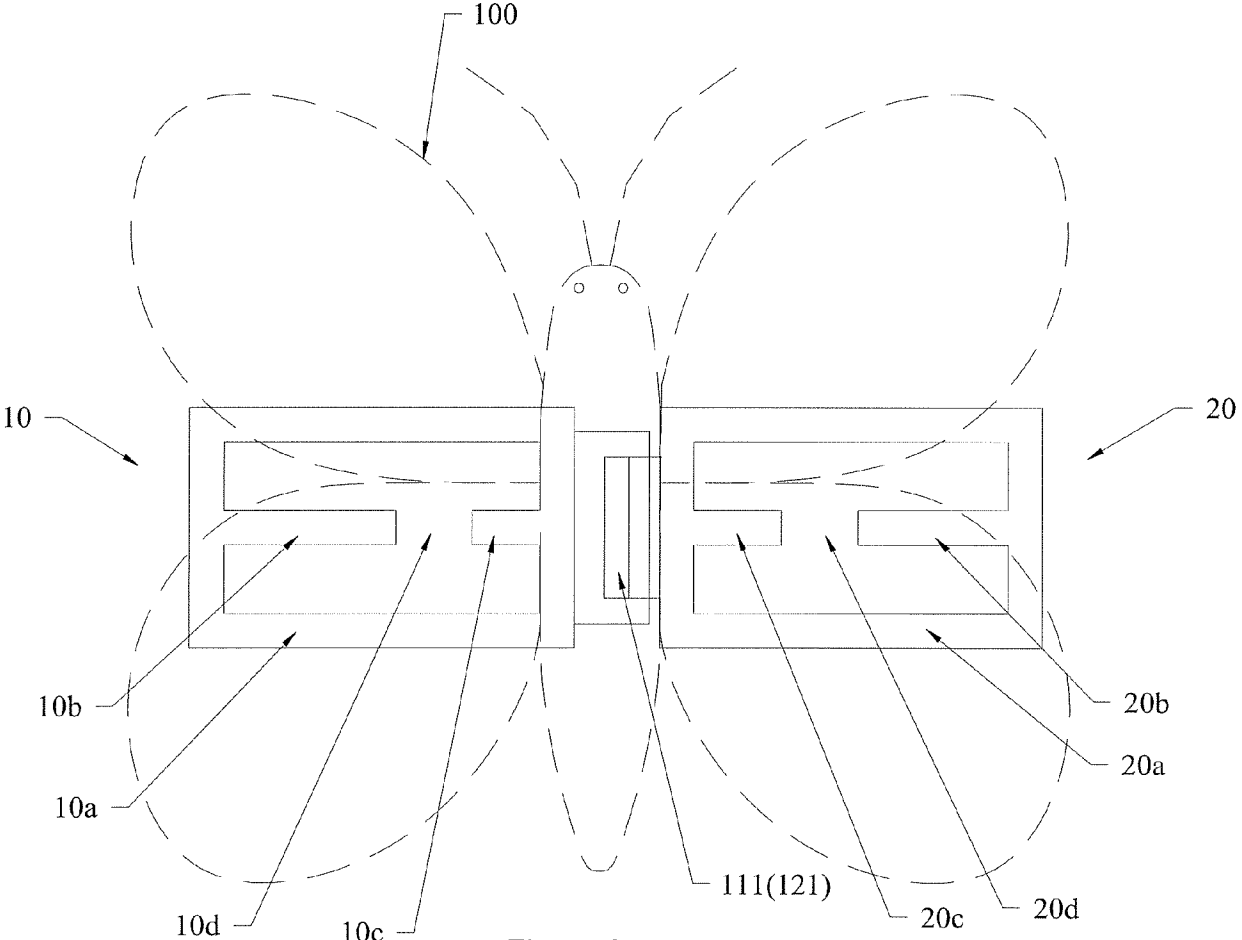
FIG. 9*a* shows the eighth embodiment of the said bra fastener assembly of this invention as connected.

In the eighth embodiment of the bra fastener assembly of this invention, as shown in FIGS. 8*a*, 9, and 9*a*, in the second embodiment of this new bra fastener assembly, the two fasteners as in first fastener 10 and second fastener 20, the first fastener 10 and the second fastener 20 are both attached to the shoulder straps 1 by the positioning elements. The positioning element can be many different shapes and sizes, in this embodiment, preferably the positioning element includes shoulder strap opening 10*a* (or 20*a*) on the edge of fastener and the first pin or long pin 10*b* (or 20*b*) as well as the second pin or short pin 10*c* (or 20*c*) in the shoulder strap opening 10*a*, between the first pin or long pin 10*b* (or 20*b*) and the second pin or short pin 10*c* (or 20*c*) is the pin gap 10*d* (or 20*d*). Shoulder strap inserts into the shoulder strap opening 10*a* through the pin gap 10*d*, and threads on the first pin or long pin 10*b* as well as on the second pin or short pin 10*c*, to secure the fastener on the bra strap 1. The shoulder strap opening may be rectangular in shape, or circular or other shapes, as long as it pairs well with shoulder strap 1, as long as the bra strap 1 can be inserted into the shoulder strap opening 10*a* (or 20*a*). Preferably the second pin or short pin is installed closer to the detachable connective element than the first pin or long pin, the recommended ratio of the length of long pin B to short pin A is 2:1~3:1, preferably 2.5:1; the recommended span of the pin gap C is 1~1.2 mm, preferably 1.1 mm. As shown in FIG. 5, according to the needs there may be two or more long pins 10*b* and short pins 10*c* in the shoulder strap opening 10*a*, this way the shoulder strap 1 threads through more times inside the shoulder strap opening 10*a*, increases the contact surface between the shoulder strap 1 and the fastener, ensuring a secure fit. In this embodiment, pin gap 10*b* is horizontally oriented, that is the first pin or long pin 10*b* and the second pin or short pin 10*c* lies perpendicular to the corresponding bra strap, and the strap inserts vertically into the fastener.

In this embodiment, the detachable connective element includes corresponding eye 111 and hook 121 between the fastener or first fastener 10 and the fastener or second fastener 20. Specifically, by installing eye 111 onto the edge of the first fastener 10, and by installing hook 121 onto the corresponding edge of the second fastener 20. When the hook 121 and eye 111 match up, the two fasteners are connected, ensuring the two bra straps remain fixed in position, preventing the bra straps from slipping off.

To enhance the look, decorative accent 100 may be added to the outer surface of the bra fastener assembly, such as decorative motifs of small animals. Specifically, by installing the decorative accent 100 directly onto the first fastener 10 surface, or the decorative accent 100 onto the second fastener 20 surface; the decorative accent can be split into two halves, installing each half onto the surface of fastener 10 and fastener 20, so when the two fasteners are connected, two parts of the decorative accent 100 become a whole image.

Figure 10:
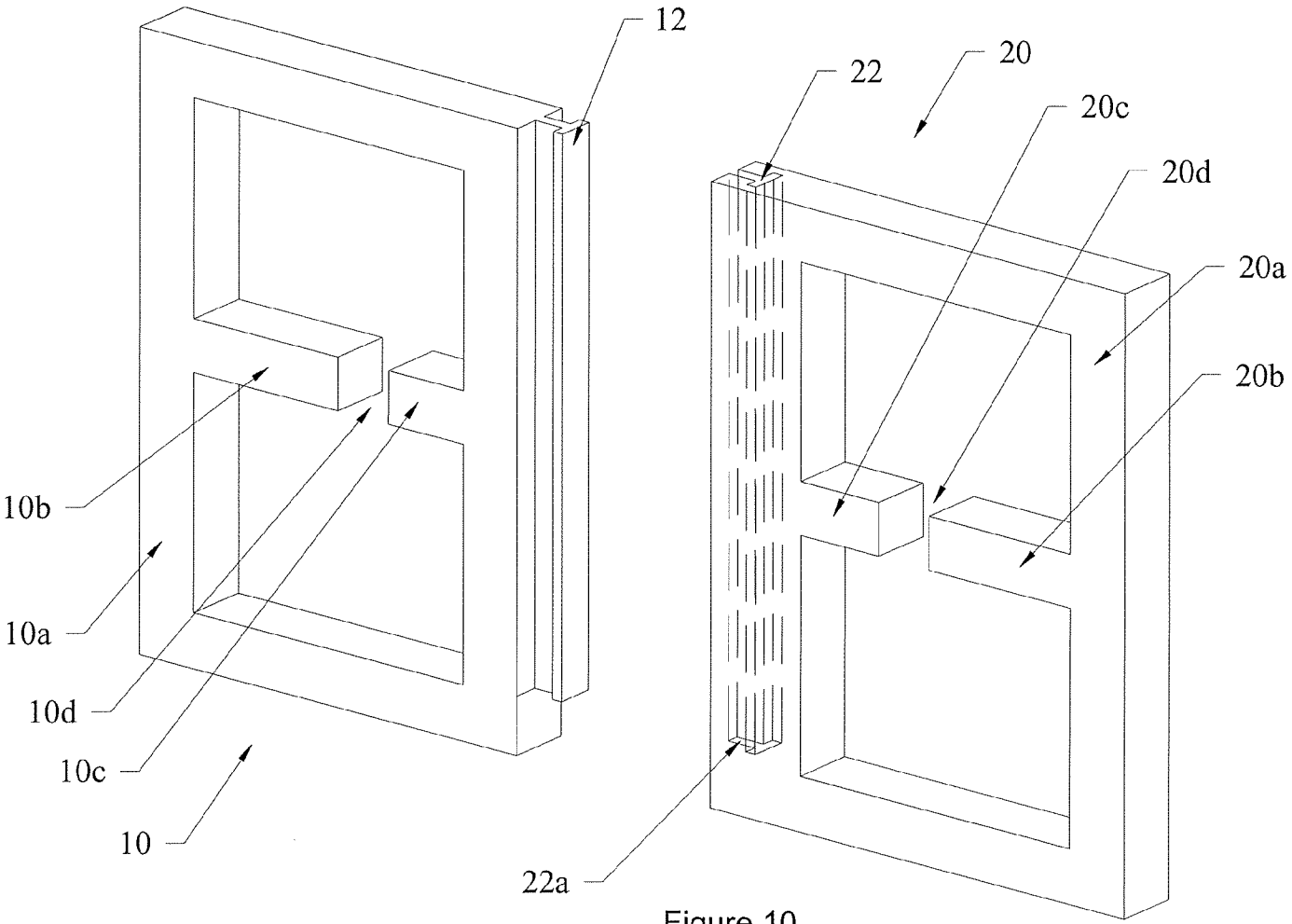
FIG. 10 shows the ninth embodiment of the structure of the said bra fastener assembly of this invention.

As shown in FIG. 10, in the ninth embodiment of the said bra fastener assembly of this invention, there are two identical fasteners. The difference from the eighth embodiment is in the detachable connective element, in this embodiment, the detachable connective element includes the matching glide rail 12 and glide track 22 between the fastener or first fastener 10 and the fastener or second fastener 20. Specifically, by installing the glide rail 12 on the edge of the fastener or the first fastener 10, and the glide rail 22 on the corresponding edge of the fastener or the second fastener 20, by matching up the glide track 22 and the glide rail 12, the two fasteners including the first fastener 10 and the second fastener 20 connect together.

In order that both fasteners match up within the glide track 22, in this embodiment, preferably by installing an end stop 22*a* on the glide track 22, so that the glide rail 12 travels a limited distance along the glide track 22 and stops, so that the connection point between the two fasteners is secure and accurate.

In this embodiment, as in the second embodiment, decorative accent 100 can be added to the outer surface of the fastener or first fastener 10 and/or fastener or second fastener 20. Both the fasteners may be attached to the bra strap using the same positioning element in embodiment eight.

Figure 11:
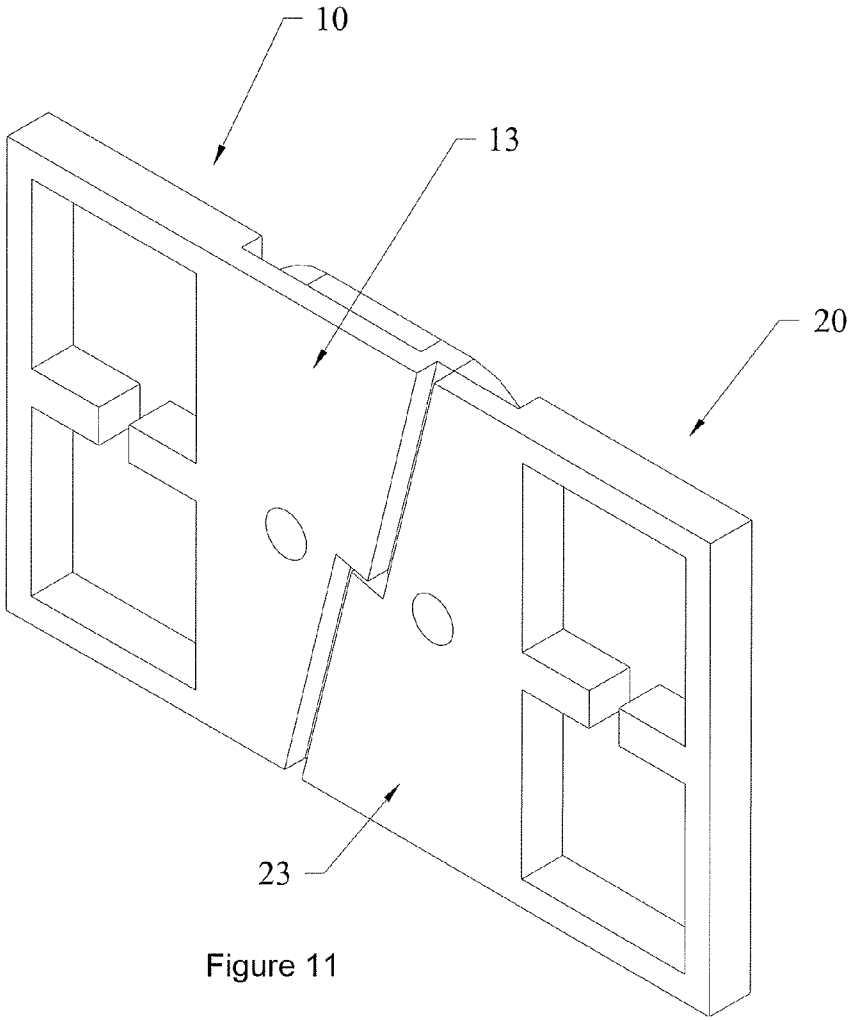
FIG. 11 shows the tenth embodiment of the structure of the said bra fastener assembly of this invention.
Figure 11A:
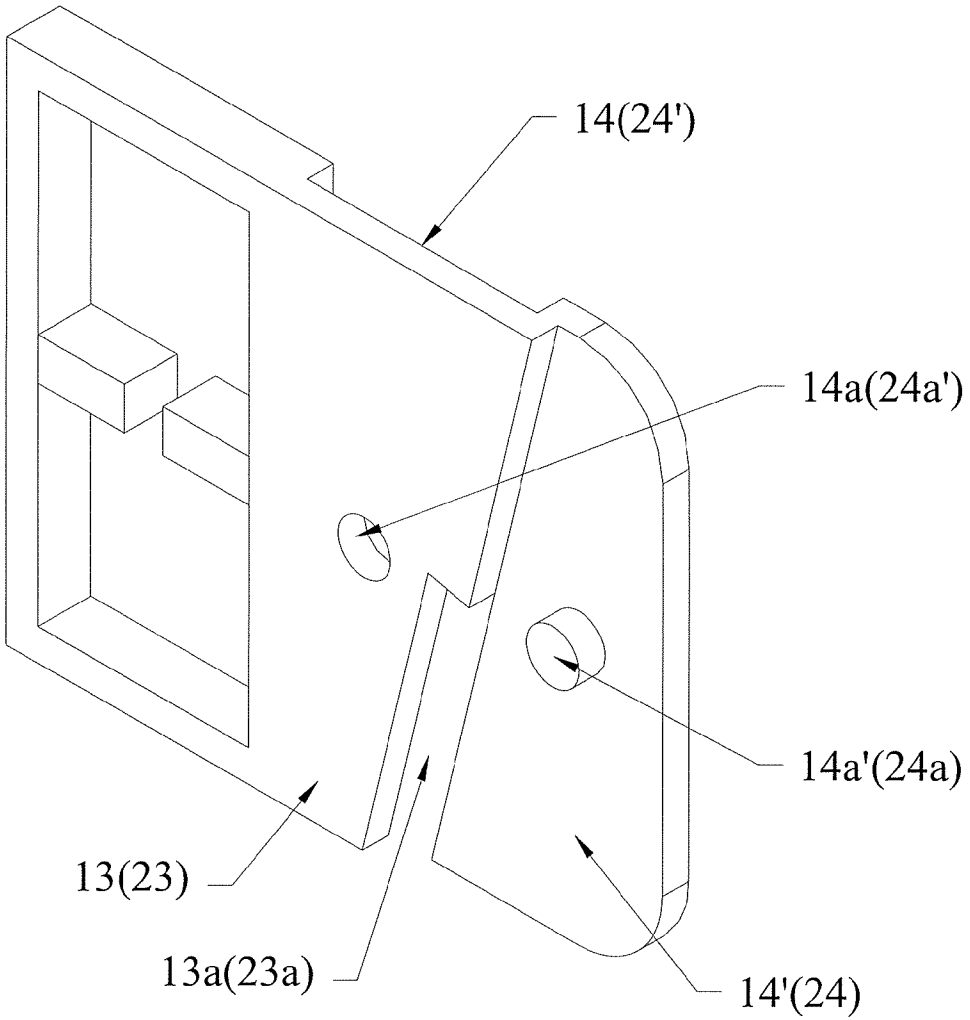
FIG. 11*a* shows the tenth embodiment of the structure of a single fastener of the said bra fastener assembly of this invention.

As shown in FIGS. 11, 11*a*, the tenth embodiment of the bra fastener assembly of this invention, there are two identical fasteners. The difference from the ninth embodiment is in the detachable connective element. In this embodiment, the detachable connective element includes the fixed gap 13*a* (or 23*a*) between the first fastener 10 and the second fastener 20, the fixed gaps 13*a*, 23*a* of the two fasteners clamp together, then the two fasteners connect together. Specifically, installing a connecting plate 13 (or 23) on one edge of the shoulder strap opening 10*a* (or 20*a*) of the fastener, in between the connecting plate 13 (or 23) lies the fixed gap 13*a* (or 23*a*). Preferably the fixed gap should be slanted towards the edge of the shoulder strap opening 10*a* of the fastener, that is the open end of the fixed gap is closer to the shoulder strap opening 10*a* than the inner end of the fixed gap, this way when the two fasteners are connected, it will not come apart easily, ensuring a secure connection. Preferably the inner end of the fixed gap is at least the height of the connecting plate, this way when the two fixed gaps clamp together, the two connecting plates of the fasteners snap together, so the connection is secure.

In this embodiment, preferably install matching alignment concave notch 14 and alignment convex platform 24 close to the fixed gap between the two fasteners including the first fastener 10 and the second fastener 20. Specifically, install the alignment concave notch 14 next to the edge of the fixed gap of the first fastener 10, install the alignment convex platform 24 next to the corresponding edge of the fixed gap of the second fastener 20, when the fixed gaps 13*a*, 23*a* of the first fastener 10 and second fastener 20 clamp together, the alignment convex platform 24 of the second fastener 20 also inserts into the alignment concave notch 14 of the first fastener, making the connection between the two fasteners more secure. Preferably, install alignment hole 14*a* in the alignment concave notch 14 of the first fastener 10, and install alignment post 24*a* on the alignment convex platform 24 of the second fastener 20; when the alignment convex platform 24 inserts into the alignment concave notch 14, the alignment post 24*a* also inserts into the alignment hole, so that there is no relative rotation between the two fasteners, or any jitter between the two fasteners.

In the embodiment shown in FIG. 11*a*, preferably both the fasteners including first fastener 10 and the second fastener 20 have identical structures, there is an alignment concave notch 14 (or 24) and an alignment convex platform 24 (or 14) on the connecting plate 13 (or 23) on both the fasteners, the alignment concave notch 14 (or 24) and the alignment convex platform 24 (or 14) are on the two surfaces of the connecting plate 13 (or 23); also install an alignment hole on the alignment concave notch; and install an alignment post on the alignment convex platform, this way when the two fasteners are connected, the connecting plates are in alignment, securing the connection between the two fasteners. It is possible to add decorative accent 100 to the outer surface of the first fastener 10 and/or second fastener 20; both the fasteners may be attached to the bra strap using the same positioning element in embodiment eight. At this time, the connection between the fasteners can be any of the previously said embodiments.

Figure 12:
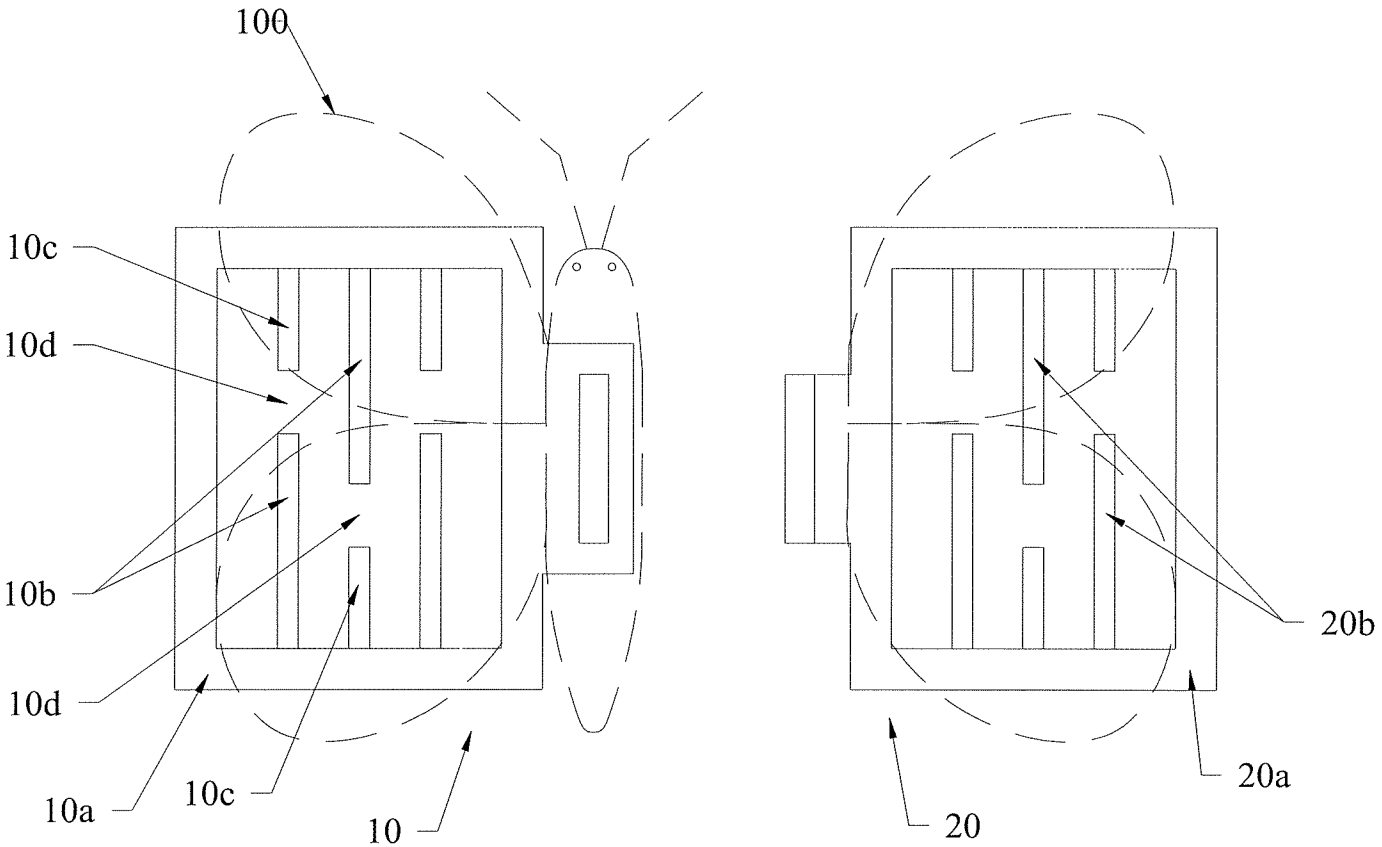
FIG. 12 shows the eleventh embodiment of the structure of the said bra fastener assembly of this invention.

In the bra fastener assembly of this invention, the two fasteners including the first fastener 10 and second fastener 20 can also be installed on the bra straps or at the point where the bra straps meet the bra cups. As shown in FIG. 12, in the eleventh embodiment, with two identical fasteners, the difference from the second embodiment is the positioning element of the fastener. In this embodiment, the first pin or long pin 10*b* of the shoulder strap opening 10*a* and the second pin or short pin 10*c* connect vertically. This way, for front opening bras, both the fasteners remain secure on the straps, and decorative accent 100 can be added to the outer surfaces of the two fasteners, adding a decorative effect.

Figure 13:
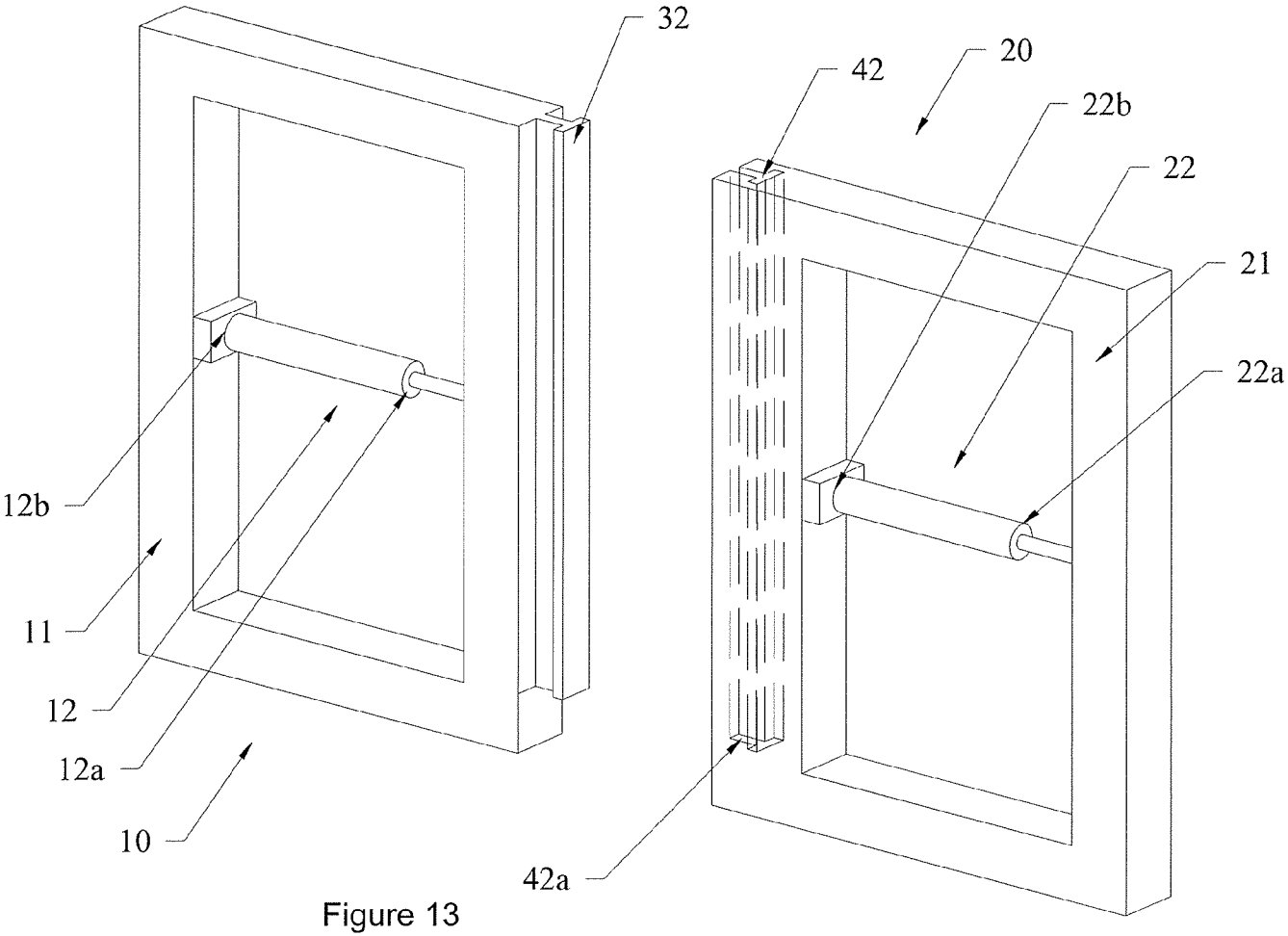
FIG. 13 shows the twelfth embodiment of the structure of the said bra fastener assembly of this invention.
Figure 13A:
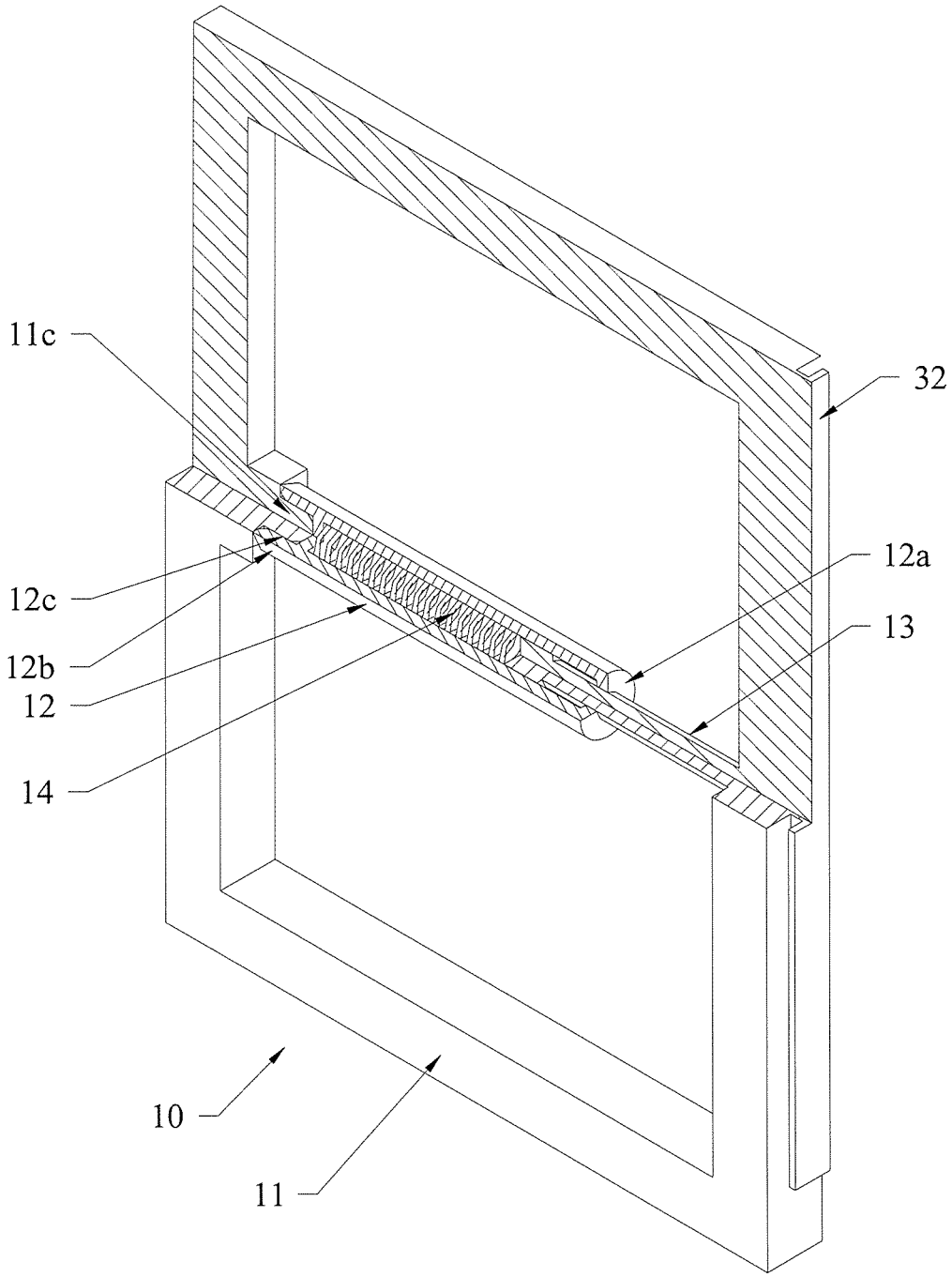
FIG. 13*a* shows the twelfth embodiment of the structure of a single fastener of the said bra fastener assembly of this invention.
Figure 13B:
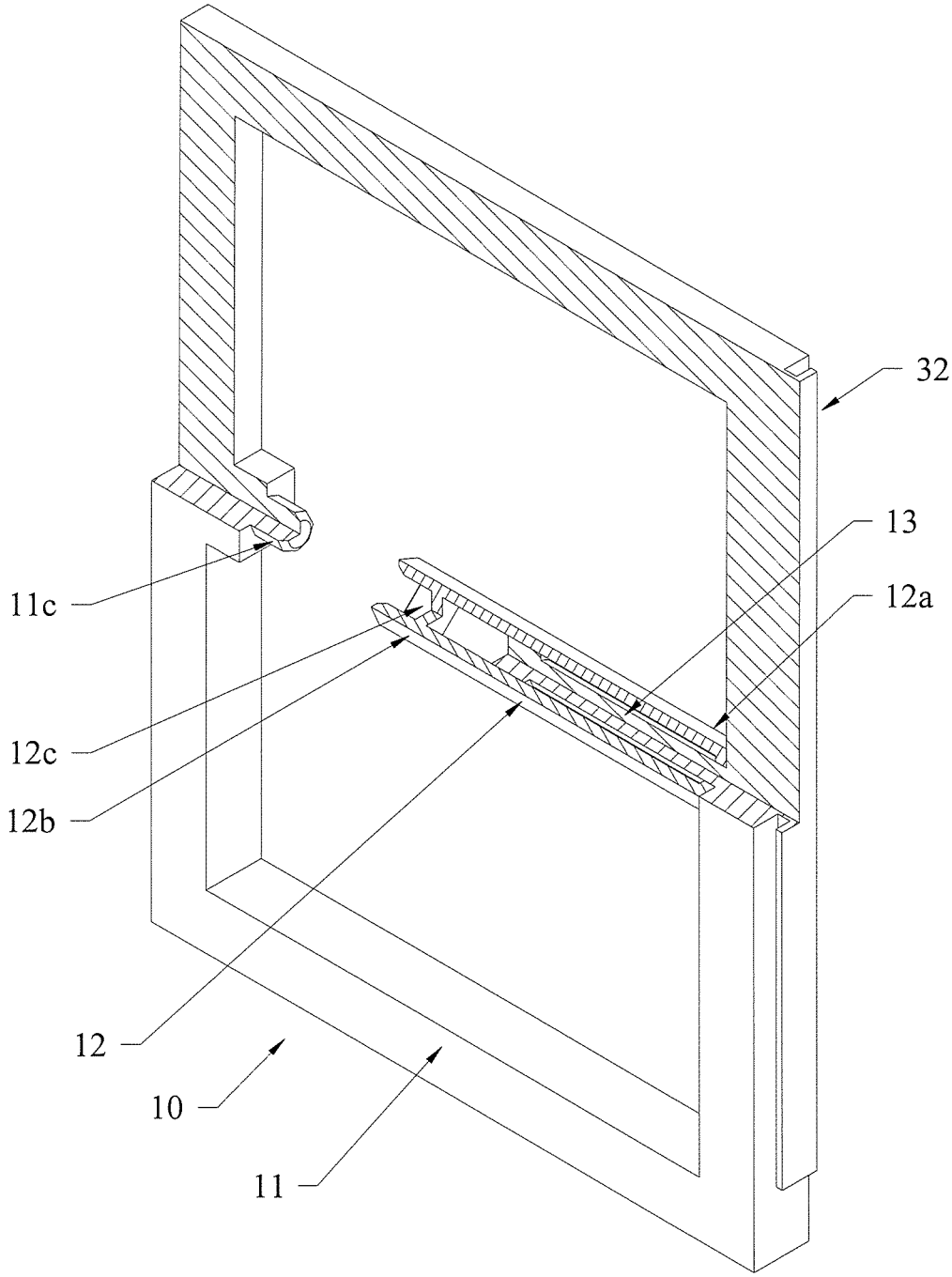
FIG. 13*b* shows the twelfth embodiment of the installation structure of a single fastener of the said bra fastener assembly of this invention.

As shown in FIGS. 13, 13*a*, and 13*b*, the twelfth embodiment of the bra fastener assembly of this invention, the two fasteners including the first fastener 10 and the second fastener 20, the first fastener 10 and the second fastener 20 are both attached to the shoulder strap 1 by positioning elements. The positioning element can be many different shapes and sizes, in this embodiment, preferably there is a shoulder strap opening 11 (or 21) on each fastener and there is a shoulder strap positioning element 12 (or 22) in each shoulder strap opening 11 (or 21), the movable connecting end 12*a* of the shoulder strap positioning element 12 is connected to the inner wall of the shoulder strap opening 11 (or 21), and the gap end 12*b* detachable connection is connected to the inner sidewall of the shoulder strap opening 11 (or 21) to form the gap.

In this embodiment, preferably the positioning element includes the shoulder strap opening 11 at one end of the fastener 10 and the shoulder strap positioning element 12 inside the shoulder strap opening 11. Shoulder strap positioning element includes the connecting end 12*a* and the gap end 12*b*, the connecting end 12*a* has a sliding connection to the inner sidewall of the said shoulder strap opening, and the gap end 12*b* is a detachable connection in the inner sidewall of the shoulder strap opening. When the gap end 12*b* of the shoulder strap positioning element opens up from the shoulder strap opening, the gap 12*n* and the inner sidewall of the shoulder strap opening 11 forms the gap. The shoulder strap 1 inserts into the shoulder strap opening through this gap, and secures by the shoulder strap positioning element, therefore the fasteners are secured onto the shoulder strap 1. The shoulder strap opening 11 can be rectangular, circular, or other shapes, as long as it pairs well with the shoulder strap 1, as long as the should strap 1 can be inserted into the shoulder strap opening 11 (or 21).

Specifically, as shown in FIGS. 13*a*, 13*b*, the inner sidewall of the shoulder strap opening 11 has a guide rail 13, the shoulder strap positioning element 12 is installed on the guide rail 13, allowing the shoulder strap positioning element 12 to glide along the guide rail 13. Preferably some elastic element such as a spring is installed between the shoulder strap positioning element 12 and the guide rail 13, allowing the gap end 12*b* to have the tendency to go towards shoulder strap opening 11, so that the gap end 12*b* of the shoulder strap positioning element and the shoulder strap opening stay in the closed position, so that the gap closes up. To insert the shoulder strap, the hand can move the shoulder strap positioning element 12, so that the gap end 12*b* of the shoulder strap positioning element moves away from the inner sidewall of the shoulder strap opening 11, and the gap opens; when installation is complete, the gap will spring close from the elastic element of the shoulder strap positioning element 12, making the installation quick and easy, as well as securing the fastener onto the default shoulder strap position.

Depending on needs it is possible to install two or more shoulder strap positioning elements within the shoulder strap opening 11, this way the shoulder strap 1 threads several times inside the shoulder strap opening 11, increasing the contact surface between the shoulder strap 1 and the fastener, to ensure a secure fit. In this embodiment, the shoulder strap positioning element 12 (or 22) positions horizontally, so that the shoulder strap positioning element 12 is perpendicular to the shoulder strap that it is paired with, the shoulder strap inserts vertically into the fastener.

In this embodiment, the detachable connective element includes the glide rail 32 and glide track 42 that lie between both fasteners, first fastener 10 and second fastener 20. Specifically, glide rail 32 is attached onto the side of the first fastener 10, glide track 42 is attached to the corresponding side on the second fastener 20, allowing both first fastener 10 and second fastener 20 to connect together. In order for both fasteners to match up within the glide track 42, in this embodiment, preferably there is an end stop 42*a* at the guide track 42, so that the glide rail 32 can travel a limited distance on the glide track 42 and stops, and the connection point between the two fasteners is secure and accurate.

The above embodiments only provide some illustrations of the possible embodiments of this invention. The explanation is very detailed and specific. This should not be viewed as the limitation of the scope of this invention. Also keep in mind that an average skilled technician in this field can come up with many modifications and embodiments based on this invention's idea. These should all be protected under the scope of this invention. Thus, the scope of protection of this invention should be based on the Claims section of this document.

The invention claimed is:

1. A bra fastener assembly for use with a bra having at least two shoulder straps and for securing the at least two shoulder straps relative to each other, comprising, i. at least two fasteners, each said fastener adapted to attach to a corresponding shoulder strap;

ii. a detachable connective element between said two fasteners to secure the shoulder straps relative to each other; and iii. a positioning element on each fastener adapted to attach to a corresponding shoulder strap, said positioning element comprises a shoulder strap opening having an inner wall and at least one first pin on said inner wall of said shoulder strap opening.

2. The bra fastener assembly according to claim 1 wherein said positioning element further comprises at least one second pin on said inner wall of said shoulder strap opening that corresponds to each of said at least one first pin, and a movable pin sleeve that fits over each pair of first and second pins.

3. The bra fastener assembly according to claim 2, wherein said shoulder strap opening has an inner wall and each said first pin having one end that is swivelly connected to said inner wall of said shoulder strap opening.

4. The bra fastener assembly according to claim 2, wherein said movable pin sleeve has an inner surface and each said first pin has an outer surface, and said inner surface of said movable pin sleeve and said outer surface of said first pin has matching pin locating elements.

5. The bra fastener assembly according to claim 2 wherein said movable pin sleeve has an inner surface and each said second pin has an outer surface, said inner surface of said movable pin sleeve and said outer surface of said second pin having matching pin locating elements.

6. The bra fastener assembly according to claim 4 wherein said movable pin sleeve glides on said outer surface of said first pin, allowing said movable pin sleeve and said second pin to disengage or engage.

7. The bra fastener assembly according to claim 2 wherein said first pin has a surface, said shoulder strap opening having an inner wall, said movable pin sleeve has an inside surface, said positioning element further comprises at least one extending element extending from said first pin's surface that is movable towards the inner wall of said shoulder strap opening, wherein said extending element and said inside surface of said movable pin sleeve matches up.

8. The bra fastener assembly according to claim 4 wherein said movable pin sleeve has an outer length and said first and second pins each has a distal end, the maximum outer length of said movable pin sleeve being more than the distance between the distal ends of said first and second pins.

9. The bra fastener assembly according to claim 2 wherein said movable sleeve has an inside, said first and second pins each has a surface, said positioning element further comprises a pin locating element, said pin locating element comprises a convex locating element on said inside of said movable sleeve and at least one concave locating element on each of the surfaces of said first and second pins.

10. The bra fastener assembly according to claim 6 wherein said movable pin sleeve has a convex locating element on the inner surface of said movable pin sleeve.

11. The bra fastener assembly according to claim 9 wherein said pin locating element comprises at least two concave locating elements on the surface of said first pin, one of which of said concave locating elements is rectangular.

12. The bra fastener assembly according to claim 1 wherein each of said fastener having an outer sidewall, said inner wall of said shoulder strap opening having at least one aperture that passes from said shoulder strap opening to said outer sidewall of said fastener, said positioning element is in said at least one aperture.

13. The bra fastener assembly according to claim 12 wherein each of said first pin has a distal end with an alignment post, and said inner wall of the said shoulder strap opening has an extendable fixed pin extending towards said first pin with an alignment hole thereon corresponding to said alignment post.

14. The bra fastener assembly according to claim 12 wherein said at least one first pin comprises at least one strap rod has a distal end and at least one slide rod, and said inner wall of said shoulder strap opening has at least one glide track that corresponds to each of said slide rod, said inner wall of said shoulder strap opening having at least one fixed pin having a distal end that corresponds to said strap rod, the distal ends of said fixed pin and said strap rod having a corresponding alignment hole and a corresponding alignment post, respectively.

15. The bra fastener assembly according to claim 1 wherein said shoulder strap opening having an inner wall and each said first pin having one end that is swivelly connected to said inner wall of said shoulder strap opening.

16. The bra fastener assembly according to claim 1 wherein said first pin is designated as the long pin, at the opposing position of said long pin is a short pin, the distance between said long and short pins defined a pin gap, the length ratio of the said long pin and said short pin is set as 2:1~3:1 and, the said pin gap is set as 1~1.2 mm.

17. The bra fastener assembly according to claim 1 wherein said detachable connective element comprises a hook and a corresponding eye, wherein said hook is on one of the at least two fasteners, and said eye is on one of the other at least two fasteners.

18. The bra fastener assembly according to claim 1 wherein said detachable connective element comprises a glide rail and a corresponding glide track, wherein said glide rail is on one of the at least two fasteners, and said glide track is on one of the other at least two fasteners.

19. The bra fastener assembly according to claim 1 said detachable connective element comprises a fixed gap on each of said at least two fasteners, said fixed gap of one of said at least two fasteners having an alignment hole and said fixed gap of the other of said at least two fasteners has a corresponding alignment post that interacts with said alignment hole.

20. The bra fastener assembly according to claim 1 wherein said first pin has a connecting end and a distal end defining a gap end that is detachably connected to said inner wall of the said shoulder strap opening; said connecting end is rotationally connected to said inner wall of the said shoulder strap opening, the rotation plane of said first pin is perpendicular to an axis of said shoulder strap opening; said inner wall of said shoulder strap opening has a guide rail and a slide mechanism on said guide rail; between said gap end and said inner wall of said shoulder strap opening is a set of a corresponding tongue and groove, each having a fitting surface; said fitting surfaces of said tongue and groove having a draft angle, an elastic rubber stop between said tongue and said groove; said detachable connective element comprises an eye and a corresponding hooks said detachable connective element further comprises a glide rail and a corresponding glide track; said glide track has a stop position; and said detachable connective element further comprises a fixed gap on each of said at least two fasteners.

* * * * *